US007487891B2

(12) United States Patent
Yerby et al.

(10) Patent No.: US 7,487,891 B2
(45) Date of Patent: Feb. 10, 2009

(54) AEROSOL ACTUATOR

(75) Inventors: Patrick Timothy Yerby, Woodstock, IL (US); Gerald J. Marquardt, Elgin, IL (US); Craig Braun, Elgin, IL (US); Jonathan D. Werner, Algonquin, IL (US)

(73) Assignee: Seaquist Perfect Dispensing Foreign, Cary, IL (US)

( * ) Notice: Subject to any disclaimer, the term of this patent is extended or adjusted under 35 U.S.C. 154(b) by 731 days.

(21) Appl. No.: 10/792,074

(22) Filed: Mar. 3, 2004

(65) Prior Publication Data

US 2005/0017027 A1 Jan. 27, 2005

Related U.S. Application Data

(60) Provisional application No. 60/451,724, filed on Mar. 3, 2003.

(51) Int. Cl.
*B67B 5/00* (2006.01)

(52) U.S. Cl. ..... 222/153.13; 222/402.11

(58) Field of Classification Search ..... 222/402.11, 222/402.13, 153.13, 153.11
See application file for complete search history.

(56) References Cited

U.S. PATENT DOCUMENTS

| | | | | |
|---|---|---|---|---|
| 2,678,147 | A | 5/1954 | Abplanalp | |
| 3,185,350 | A | 5/1965 | Abplanalp et al. | |
| 3,325,054 | A | 6/1967 | Braun | |
| 3,426,948 | A * | 2/1969 | Stirling | 222/402.11 |
| 3,484,023 | A | 12/1969 | Meshberg | |
| 3,591,128 | A | 7/1971 | Ramis | |
| 3,601,290 | A | 8/1971 | Nigro | |
| 3,744,682 | A | 7/1973 | Blank | |
| 3,797,705 | A | 3/1974 | Cooprider | |
| 3,848,778 | A | 11/1974 | Meshberg | |
| 3,860,149 | A | 1/1975 | Hagianis | |
| 3,933,283 | A | 1/1976 | Hoagland | |
| 3,967,760 | A | 7/1976 | Marcon | |
| 4,024,988 | A | 5/1977 | Starrett | |
| 4,324,351 | A | 4/1982 | Meshberg | |
| 4,354,621 | A * | 10/1982 | Knickerbocker | 222/153.11 |
| 4,418,842 | A | 12/1983 | DiLoreto | |
| 4,542,837 | A | 9/1985 | Rayneer | |
| 4,773,567 | A | 9/1988 | Stoody | |
| 5,388,730 | A | 2/1995 | Abbott et al. | |

(Continued)

FOREIGN PATENT DOCUMENTS

| | | |
|---|---|---|
| EP | 119084 | 9/1985 |

(Continued)

*Primary Examiner*—Philippe Derakshani
(74) *Attorney, Agent, or Firm*—Frijouf, Rust & Pyle, P.A.

(57) ABSTRACT

An actuator is disclosed for actuating an aerosol valve for dispensing an aerosol product from an aerosol container. The actuator comprises an actuator button being rotatable relative to a base for movement between a locked rotational position and an unlocked rotational position. The actuator button has a rigid sidewall supporting a rigid top actuating surface with an actuator button orifice defined in the sidewall of the actuator button. The actuator button is movable relative to the base for actuating the aerosol valve to dispense the aerosol product when the actuator button is rotated into the unlocked rotational position. The actuator button is inhibited from actuating the aerosol valve when the actuator button is moved into the locked rotational position.

7 Claims, 30 Drawing Sheets

U.S. PATENT DOCUMENTS

| | | | | |
|---|---|---|---|---|
| 5,649,645 | A | 7/1997 | Demarest et al. | |
| 5,918,774 | A | 7/1999 | Lund | |
| 5,957,337 | A | 9/1999 | Bettison, Jr. | |
| 5,971,214 | A | 10/1999 | Bettison, Jr. | |
| 5,971,230 | A | 10/1999 | Tanaka | |
| 6,299,027 | B1 | 10/2001 | Berge et al. | |
| 6,302,302 | B1 | 10/2001 | Albisetti | |
| 6,523,722 | B1 | 2/2003 | Clark et al. | |
| 6,695,171 | B2 * | 2/2004 | Walters et al. | 222/153.13 |
| 6,758,373 | B2 | 7/2004 | Jackson et al. | |
| 2005/0017026 | A1 | 1/2005 | Yerby et al. | |
| 2005/0017027 | A1 | 1/2005 | Yerby et al. | |

FOREIGN PATENT DOCUMENTS

| | | |
|---|---|---|
| EP | 409497 | 1/1991 |
| EP | 503735 | 9/1992 |
| EP | 0 659 157 | 6/1995 |
| EP | 0935567 | 4/1998 |
| EP | 1061007 | 5/2000 |
| EP | 1 219 547 | 7/2002 |
| EP | 1219547 | 7/2002 |
| EP | 1323644 | 7/2003 |
| WO | WO 98/16439 | 4/1998 |
| WO | WO 99/33716 | 7/1999 |
| WO | WO 2007-022422 | 2/2007 |

* cited by examiner

AEROSOL ACTUATOR

CROSS-REFERENCE TO RELATED APPLICATIONS

This application claims benefit of U.S. Patent Provisional application Ser. No. 60/451,724 filed Mar. 3, 2003. All subject matter set forth in provisional application Ser. No. 60/451,724 is hereby incorporated by reference into the present application as if fully set forth herein.

BACKGROUND OF THE INVENTION

1. Field of the Invention

This invention relates to dispensing of an aerosol product and more particularly to an improved aerosol actuator having an actuator button being rotatable relative to a base for enabling and inhibiting the dispensing of the aerosol product from an aerosol container.

2. Background of the Related Art

An aerosol dispenser comprises an aerosol product and an aerosol propellant contained within an aerosol container. An aerosol valve is provided to control the discharge of the aerosol product from the aerosol container through the fluid pressure provided by the aerosol propellant.

The aerosol valve is biased into a closed position. A valve stem cooperates with the aerosol valve for opening the aerosol valve. An actuator engages with the valve stem to open the aerosol valve for dispensing the aerosol product and the aerosol propellant from the aerosol container. The aerosol product and the aerosol propellant are dispensed from the aerosol valve through a spray nozzle. Typically, the aerosol product and the aerosol propellant are contained in a common portion of the aerosol container.

The following U.S. patents represent certain attempts of the prior art to provide an aerosol actuator for permitting and inhibiting the dispensing of an aerosol product from an aerosol container.

U.S. Pat. No. 2,678,147 to Abplanalp discloses the dispensing of aerosols in foam form, in contradistinction to those aerosols which are delivered in the form of spray or mist. The invention is particularly adapted for use in conjunction with toiletries in cream, paste and lather form, e.g., tooth paste, shaving cream, soap, etc., as well as a wide variety of other materials which it may be desirable to dispense in foaming condition. The object of this invention is to provide a highly efficient, convenient and easily operated dispensing head adapted to be attached to an aerosol pressurized container and so constituted as to preclude inadvertent dispensing of the material during shipment or handling. It is characteristic of the invention, as it will hereinafter be more fully explained, that containers equipped with the head of the present invention may be stacked one upon another in shipping cartons or for display purposes, without danger of releasing the material from any of them.

U.S. Pat. No. 3,185,350 to Abplanalp et al. teaches aerosol dispensers and is directed, more particularly, to a novel form of valve actuator and a cooperating protective hood. The object of the invention is to so constitute the tab cap and hood that they may be adjusted into different relative positions. To lock the valve actuator against inadvertent operation, particularly during shipment and shelf life of the dispenser; to permit said actuator to be retained in position wherein the valve of the dispenser will be held open for continuous discharge of the aerosol material; and to permit the valve actuator to partake of a position wherein it may be intermittently operated by the user for such relatively short periods as such user may desire.

U.S. Pat. No. 3,325,054 to Braun teaches actuators for aerosol valves and more particularly to an actuator for an aerosol valve having a construction so that the valve cannot be intentionally or accidentally operated, until the actuator is placed in an operative position.

U.S. Pat. No. 3,484,023 to Meshberg discloses a dispensing means having a housing carried by a valved container of material under pressure. The housing rotatably and slidably supports a dispensing button in dispensing and nondispensing positions. The button has a dispensing orifice or nozzle in the side thereof and a laterally projecting control tab. With the button in dispensing position, the orifice is exposed and the tab is aligned with a slot in the housing permitting the button to move inwardly to operate the valve to dispense the material from the container. When the button in its outward position is rotated to nondispensing position, manually or automatically, the nozzle engages a flexible wall on the housing to wipe and seal the same and the control tab engages the housing and prevents operation of the button.

U.S. Pat. No. 3,591,128 to Ramis discloses that the accidental release of fluid from containers in which it is under gas pressure, e.g., aerosol canisters, may be prevented by making part of the valve assembly rotatable about the valve stem. In one rotary position the pushbutton may be depressed while in another rotary position abutments on the neck of the container and on the pushbutton confront one another and prevent such action.

U.S. Pat. No. 3,744,682 to Blank teaches a safety overcap which, when attached to an aerosol container, provides pivot locking of the actuator means to prevent uninformed users such as children from dispensing products which may cause harm to them or others.

U.S. Pat. No. 3,797,705 to Cooprider discloses an actuator of the dispensing device which is movable through an opening in the closure cap of the container provided with a generally stiff radially deflectible locking finger extending in the direction of the actuator movement. Its free end is adapted for radial deflection into and from an operative position in which the free end is in abutting engagement with the upper axial end of the annular abutment. In the released or inoperative position, the finger extends and is freely movable in a space provided between the actuator and the annular abutment which encircles it. Cooperating cam means on the finger and the abutment are operative in one direction of rotation of the actuator to urge the free end of the finger radially outwardly to locking position and are operative in the reverse direction of rotation of the actuator to urge the fingers radially inwardly toward released position.

U.S. Pat. No. 3,848,778 to Meshberg teaches an actuator button mounted in a housing to form an actuator assembly which is secured to a valved aerosol or other container. The actuator button is rotatable between non-dispensing and dispensing positions. With the actuator button in the non-dispensing position, cooperable portions of the actuator assembly form a locking means to positively prevent rotational movement of the actuator button and, simultaneously, blocking means prevents operation of the dispensing valve. While the locking means is disabled by disengaging the cooperable portions, the actuator button is simultaneously rotated free of the blocking means into the dispensing position for dispensing product from the container by operation of the valve as by depressing or tilting the actuator button. Limiting means restricts relative movement of the cooperable portions of the locking means to prevent permanent deformation thereof. A breakaway tab prevents disabling the locking means until the tab is removed. The actuator assembly is shaped to conceal the locking means to further prevent accidental operation of the valve by children. An alternative embodiment is adapted for use on large diameter containers.

U.S. Pat. No. 3,967,760 to Marcon discloses an actuator cap assembly for an aerosol dispenser. The cap includes a body having a slide surface formed thereon, and a movable slide carriage member mounted in the slide for linear movement. The carriage is movable between a first position where the actuator button of the aerosol dispenser can be actuated and a second position where it is not possible to activate the dispenser button.

U.S. Pat. No. 4,024,988 to Starrett teaches a safety closure assembly comprising an overcap rotatably mounted on and substantially enclosing the valve end of an aerosol container, having a valve actuating tab with a spray orifice through which the container contents are discharged when the tab is depressed. A keying element associated with the tab functions to prevent its depression under certain conditions. A collar member is provided for association with the overcap, the collar member being non-rotatably mountable on the valved end of the container and having a shelf forming a blocking position, a lock-out spring which is resiliently flexible in a direction parallel to the container axis, and an upstanding catch formed on the lock-out spring. The valve actuating tab is normally disabled from operating the valve by interference of its keying element with the free end of a C-shaped ring. The ring is supported by the collar and its free end is normally urged between the keying element and the blocking portion of the collar. The ring is resiliently distortable in a plane perpendicular to the container axis and has a leg projecting in that plane which is engaged by an internal abutment in the overcap upon rotation of the latter to bend the free end of the ring outwardly away from the container axis, whereby to remove it from interfering relation with the tab keying element.

U.S. Pat. No. 4,418,842 to Diloreto discloses a child resistant actuator cap for a pressurized aerosol dispenser or the like which operates in only one relative alignment of the cap and a collar affixed to the container. Alignment is signalled to the user by a predetermined number of clicks of a flexible blade following a blank space which produces no clicks. U.S. Pat. No. 4,324,351 to Meshberg discloses a dispensing actuator which includes a button rotatable between a dispensing and nondispensing position, between two stops. The button has a tab engaging the stops, to avoid overriding the stop in the dispensing position. The tab has an inwardly extending lip which abuts against the stop. The button also may include a flash burr formed on the outer circumference of the inner end of the button to frictionally engage the inside of the bore to permit automatic assembly of the actuator onto the container and valve without danger of the button falling out of the housing.

U.S. Pat. No. 4,542,837 to Rayner discloses an actuator for an aerosol container having upper and lower rotatable parts which may be rotated between an operative and an inoperative position. When rotated into the operative position, an actuating member is raised by cam action to a position where it engages an arm member, whereby the valve of the aerosol container may be actuated. When rotated to the inoperative position, the actuating member is lowered by cam action to a position where it is flush with the upper rotatable part and does not engage the arm member and whereby the valve of the aerosol container cannot be actuated.

U.S. Pat. No. 4,773,567 to Stoody teaches a fluid dispenser valve actuator that includes stop and abuttments that accommodate selective positioning of the actuator to an OFF position, preventing opening of the valve, from an ON position facilitating opening of the valve, and viceversa. The actuator also includes a manipulative latching pawl and a catch that are latchingly engaged to prevent a positional change when the actuator is in the OFF position, except when pawl is manipulated to disengage the catch.

U.S. Pat. No. 5,388,730 to Abbott et al. discloses a lockable actuator mechanism for an aerosol or pump dispensing canister. The lockable actuator comprises a collar fixedly mounted to a canister and an actuation plunger concentrically mounted in the collar. The collar includes a shoulder onto which the actuation plunger may be rotated into a locked, safety position to prevent depression of the plunger. Tabs located on the collar above the plunger prevent the plunger from being removed from the housing and cooperate with a detent on the shoulder to wedge the plunger over the shoulder and prevent the plunger from rotating back into the operative position. The tabs also eliminate the need for a friction fit of the actuation plunger on the valve stem. The actuation plunger has an internal annular shoulder against which the valve stem abuts in the depressed position. In the non-dispensing position, a clearance gap is provided between the valve stem and the annular shoulder to prevent accidental depression or tilting of the valve stem by jostling of the actuation plunger. A strong spring aids in biassing the valve stem against the annular shoulder to form a tight seal against leaks during actuation and closes the valve mechanism when the plunger is not depressed.

U.S. Pat. No. 5,649,645 to Demarest et al. teaches an overcap sprayer assembly and method of its manufacture. The overcap sprayer assembly includes an actuator and an overcap. The actuator has a body and a sprayer arm. The body attaches preferably to the valve cup rim of the can. A skirt extends circumferentially around the perimeter of the body. At least one actuator access port provides access through the skirt to the interior of the body. The sprayer arm of the actuator has a nozzle adapted to direct spray outwardly through an actuator access port. The overcap attaches to the skirt of the actuator body in coaxially turning relation thereto. An overcap wall extends downwardly from the outer margins of the overcap dome, surrounding the actuator body. The overcap also has at least one overcap access port that may be moved between an open position, wherein an overcap access port is aligned with the actuator access port through which the nozzle is adapted to direct spray, and a closed position, wherein the overcap wall obstructs the actuator access port. Preferably a lock member extends from one of the actuator body and the overcap to project into and engage an opposed locking port of the other of the actuator body and overcap. Preferably the locking port is an access port. The lock member has an unlocked position, wherein it is not engaged in an opposed locking port and the overcap may freely turn on the actuator body, and a locked position assumed when the lock member becomes aligned with an opposed locking port, projects thereinto, and engages the opposed locking port, resisting further overcap turning.

U.S. Pat. No. 5,918,774 to Lund discloses a spray package having a container body, an actuator, and a shroud between the container body and the actuator. The actuator has a nozzle, and is adjustable between a locked position and an unlocked position by rotation of the nozzle about the actuator's longitudinal axis. The unlocked position allows vertical movement of the actuator for dispensing product from the package, and the locked position prevents vertical movement of the actuator to prohibit dispensing of product from the package. The locked position simultaneously provides cooperation between the nozzle and an anti-clog member, connected to and extending above the shroud. The anti-clog member has a nozzle seal on its inside surface which inhibits clogging of product within and about the nozzle when the seal is in contact with the nozzle.

U.S. Pat. No. 5,957,337 to Bettison, Jr. discloses a child resistant aerosol spray apparatus. The safety apparatus is provided which is adaptable to an aerosol spray can such that spraying can occur only in one direction or in a limited number of desired directions. The direction of spraying is in accordance with a feature on a spray head and a mating feature on a mounting cup, when mating alignment is achieved spraying can occur. When the spray head and the mounting cup are out of mating alignment spraying cannot occur.

U.S. Pat. No. 5,971,214 to Bettison, Jr. discloses a child resistant, spray through overcap aerosol spray apparatus The safety apparatus is provided which is adaptable to an aerosol spray can such that spraying can occur only in one direction or in a limited number of desired directions. The direction of spraying is in accordance with a feature on a spray head and a mating feature on a mounting cup, when mating alignment is achieved spraying can occur. When the spray head and the mounting cup are out of mating alignment spraying cannot occur.

U.S. Pat. No. 5,971,230 to Tanaka discloses a spray quantity control nozzle for use in an aerosol container wherein spray quantities of the contents of the aerosol container can be adjusted in two stages as increased or reduced corresponding to specific depression depths of a nozzle body. A depressible depth of the nozzle body for a smaller spray quantity and that for a larger spray quantity can be surely set. The spray quantity control nozzle comprising a mounting part mounted on a mouth of the aerosol container and the nozzle body fit onto a projecting part of a valve stem of a flow control valve. The nozzle body is connected to the mounting part through a first molded hinge. A movable leaf is connected to the mounting part through a second molded hinge, so that a depressible depth of the nozzle body becomes smaller when the movable leaf is stood up into its working posture, and becomes larger with the movable leaf falling down in its withdrawal posture.

U.S. Pat. No. 6,299,027 to Berge et al. discloses a valve controlled dispensing closure A push valve dispensing closure includes a base mountable to the mouth of a container. A valve is mounted within the base and a cap cooperatively is engaged upon the base for rotational movement of the valve relative to the base between locked and unlocked positions, in the unlocked position, between a first closed position and a second open position with respect to the base. The base is formed with a product dispensing channel having a wall with a generally conical-shaped cross-sectional configuration and the valve has depending spring-action circumferential flange segments formed thereon for cooperative engagement with the conical-shaped wall. The cap includes a discharge orifice closed by a panel on the valve with rotation of the cap relative to the valve after movement of the valve to the unlocked position, opening the orifice.

U.S. Pat. No. 6,302,302 to Albisetti discloses a lockable dispensing head and dispenser equipped therewith. The dispensing head and a dispenser are equipped with this head for dispensing a liquid product. The dispensing head including a band having an open end fixed to a reservoir which contains the product and is equipped with a dispensing valve, and a push-button intended to control the opening of the valve. The push-button has an actuating surface and a dispensing orifice in communication with the valve. A device is provided for positioning the push-button with respect to the band and for selectively positioning the push-button in an actuating position which allows product to be dispensed, or in a locked position to prevent the valve from being actuated. The push button and the band are configured in such a way that the push-button can be mounted and removed only through the open end of the band.

U.S. Pat. No. 6,523,722 to Clark et al. discloses a spray-head for example for an aerosol or pumpspray container comprising a support, a fluid outlet mounted on the support, a passageway connected to the fluid outlet at a first end and connectable to a fluid source at a second end. The passageway is movable between a first non-operative position and a second position in which, in use, it is connected to a fluid source such that fluid can pass through the passageway to the fluid outlet. A member secured relative to the support, the member being movable between a non-operative position and a further position in which it allows the passageway to attain its second position. A lock is selectively operable to lock the member in its first position, thereby preventing the member from urging the passageway to its second position unless the lock is released.

European Patent EP 119,084 to Metal Box P.L.C. teaches an actuator of the "spraydome" type for an aerosol container comprising upper and lower parts rotatable between operative and inoperative positions. The upper actuator part carrying an actuator member which is moved to a raised position by cam action of engageable surfaces of the actuator parts when the actuator is moved from the inoperative to the operative position, whereupon the actuating member can be depressed to actuate the aerosol valve, whereas in the inoperative position of the actuator the actuating member is in a depressed position and cannot actuate the aerosol valve.

European Patent EP 409,497 to Tiram Kimia discloses a cap comprising a cover and a tubular body for use on a aerosol can. The tubular body fitted onto the aerosol can contains a perpendicular bar and horizontal bar ducts to release the contents on the can. To activate the ejection valve stem a lever mechanism is incorporated in the cover which can be disposed in an open and close position. In the open position, the upper portion of the cover depressed, activates the ejection valve stem releasing the contents. When upper portion of cover is moved to a closed position, it is not possible to accidentally activate the ejection valve stem. Audible sound is created when the cover reaches the open and closed position.

EP 503735 to Plasticum B.V. discloses a combination of an aerosol can and cap placed on the aerosol can. The cap is provided with a shell having at least one locking lip near its open lower end. The locking lip engaging under a collar provided at the upper end of the aerosol can and wherein the cap comprises an operating arm pivotally coupled to the remainder of the cap for operating a valve of the aerosol can. The arrangement being such that by pivoting the operating arm contents of the aerosol can will be discharged via the valve. Characterised in that inside the shell of the cap there has been secured a wing to a part of the shell, which can be pressed inwards with respect to the remainder of the shell in that in the unloaded condition of the part of the cap placed on the can a lower boundary edge of the wing is in abutment with part of the aerosol can and the wing is just below a lower boundary edge of the operating arm for locking the arm. By loading the part of the shell supporting the wing for pressing inwards the part of the shell the lower boundary edge of the wing is pivoted about a pivot axis extending at least substantially parallel to the central axis of the aerosol can, while moving along said abutment part of the aerosol can, to a position wherein the operating arm is able to pivot downwards.

European Patent EP 1219547 to Unilever PLC teaches a sprayhead for example for an aerosol or pump spray container comprising a support, a fluid outlet mounted on the support, a passageway connected to the fluid outlet at a first end and connectable to a fluid source at a second end. The passageway is movable between a first non-operative position and a second position in which, in use, it is connected to a fluid source such that fluid can pass through the passageway to the fluid outlet. A member secured relative to the support, the member is movable between a non-operative position and a further position in which it allows the passageway to attain its second position. A lock is selectively operable to lock the member in its first position, thereby preventing the member from urging the passageway to its second position unless the lock is released.

European Patent EP 1323644 to Unilever PLC discloses a sprayhead for example for an aerosol or pump spray container comprising a support, a fluid outlet mounted on the support, a passageway connected to the fluid outlet at a first end and connectable to a fluid source at a second end, the passageway being movable between a first non-operative position and a second position in which, in use, it is connected to a fluid source such that fluid can pass through the passageway to the fluid outlet, a member secured relative to the support, the member being movable between a non-operative position and a further position in which it allows the passageway to attain its second position. A lock selectively operates to lock the member in its first position, thereby preventing the member from urging the passageway to its second position unless the lock is released.

Therefore, it is an object of the present invention to provide an improved actuator having an actuator button being rotatable between an unlocked and a locked rotational position for permitting and inhibiting the dispensing of an aerosol product therefrom.

Another object of this invention is to provide an improved actuator having an actuator button that is tiltable for dispensing the aerosol product when the actuator button is rotated into the unlocked rotational position and for inhibiting the tilting of the actuator button when the actuator button is moved into the locked rotational position.

Another object of this invention is to provide an improved actuator having an actuator button that is tiltable in entirety when the actuator button is moved into the unlocked rotational position.

Another object of this invention is to provide an improved actuator having an actuator button that is a rigid unitary actuator having a rigid top actuating surface for tilting the entirety of the unitary actuator button upon depression of the top actuating surface.

The foregoing has outlined some of the more pertinent objects of the present invention. These objects should be construed as being merely illustrative of some of the more prominent features and applications of the invention. Many other beneficial results can be obtained by applying the disclosed invention in a different manner within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an actuator for actuating an aerosol valve for dispensing an aerosol product from an aerosol container. The actuator comprises a base having a mounting for securing to the aerosol container. A nozzle defines a nozzle channel extending between the aerosol valve and a terminal orifice. An actuator button is rotatable relative to the base for movement between a locked rotational position and an unlocked rotational position. The actuator button has a rigid sidewall supporting a rigid top actuating surface with an actuator button orifice defined in the sidewall of the actuator button. The actuator button is movable relative to the base for actuating the aerosol valve to dispense the aerosol product from the aerosol container for discharge through the terminal orifice when the actuator button is rotated into the unlocked rotational position. The actuator button is inhibited from actuating the aerosol valve when the actuator button is moved into the locked rotational position.

Preferably, the actuator button is formed as a rigid unitary actuator. In one example, the actuator button comprises a rigid sidewall supporting a rigid top actuating surface. The essential totality of the unitary actuator button is tilted relative to the base upon depression of the top actuating surface for actuating the aerosol valve for dispensing the aerosol product from the aerosol container when the actuator button is rotated into the unlocked rotational position.

In a more specific embodiment of the invention, the nozzle has a nozzle channel extending between a first and a second end. The first end of the nozzle channel engages with the aerosol valve whereas the second end of the nozzle channel defines a terminal orifice.

In another specific example, the base includes a coaxial outer ring and an inner ring defined about a common axis and forming an annular void therebetween. The actuator button is rotatably disposed between the outer ring and the inner ring of the base. A bridge extends between the outer ring and the inner ring and is disposed at a first portion of the base. The bridge inhibits a first portion of the actuator button from moving into the void concomitantly with a second portion of the actuator button moving into the void upon the tilting of the actuator button when the actuator button is rotated into the unlocked rotational position.

In one embodiment of the invention, the nozzle is resiliently mounted to the base for actuating the aerosol valve upon a pivoting of the nozzle. The actuator button includes an orifice defined in a sidewall of the actuator button. The orifice of the actuator button is aligned with the terminal orifice when the actuator button is rotated into the unlocked rotational position. The orifice of the actuator button covers the terminal orifice when the actuator button is rotated into the locked rotational position.

In an alternate embodiment of the invention, the actuator button includes a support for mounting the nozzle to the actuator button. The terminal orifice is defined within an actuator sidewall of the actuator button. The terminal orifice of the actuator button is located above the base when the actuator button is rotated into the unlocked rotational position.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several FIGS. of the drawings.

DETAILED DISCUSSION

Figure 1:
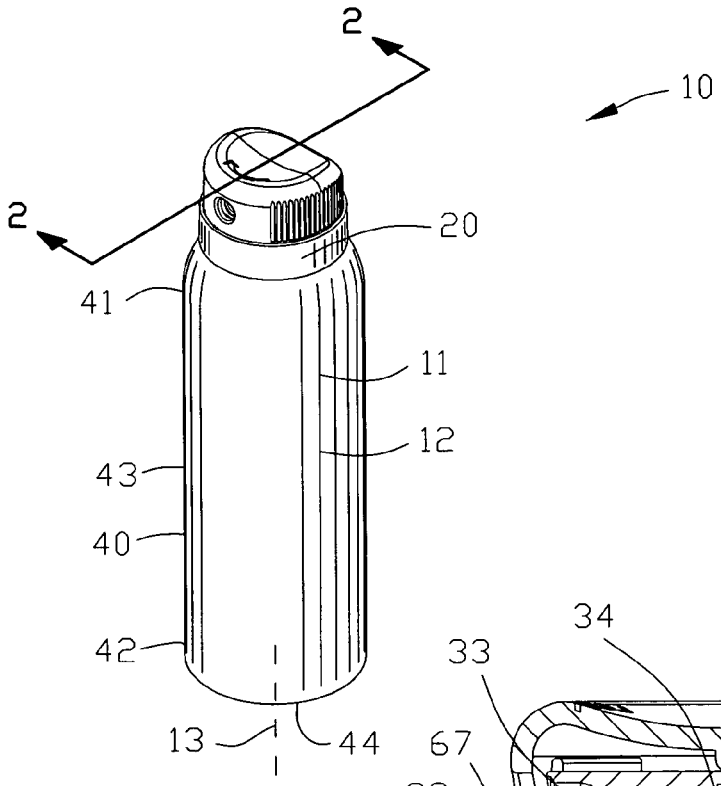
FIG. 1 is a top isometric view of a first embodiment of the improved actuator of the present invention located on an aerosol container.
Figure 2:
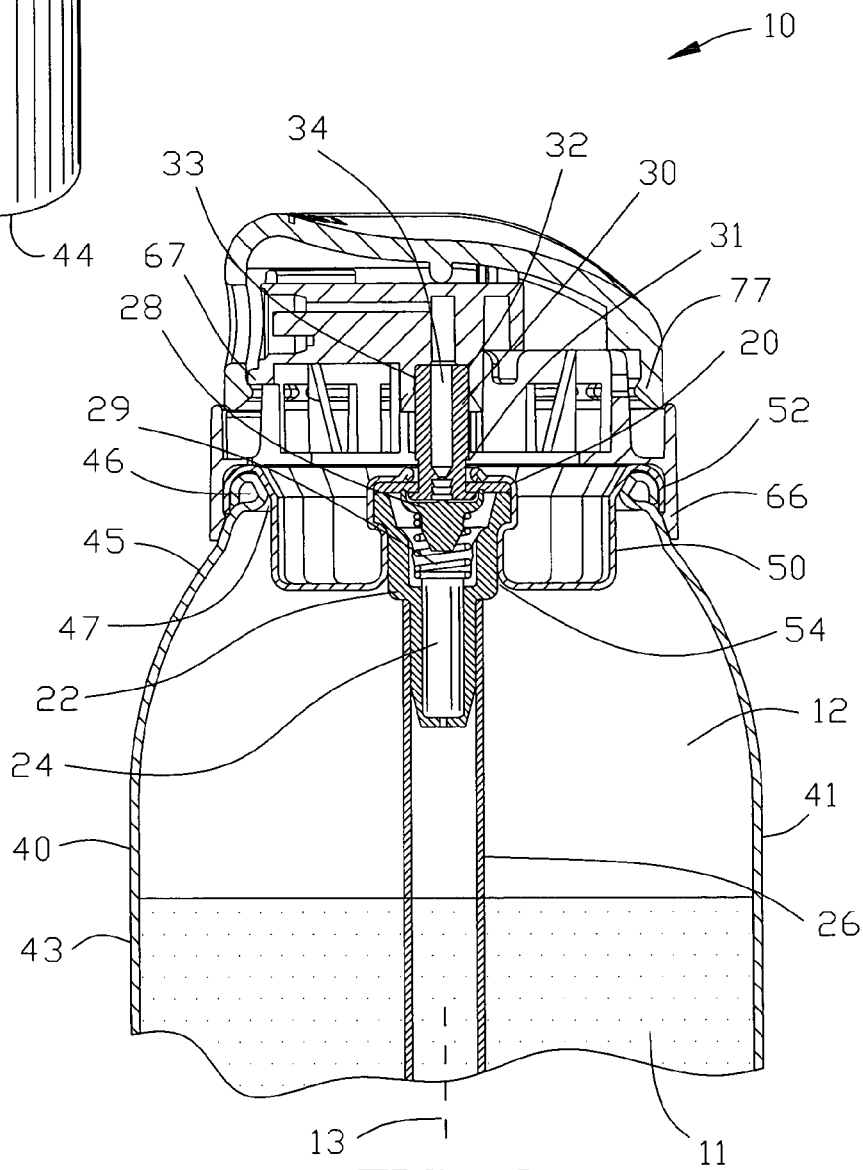
FIG. 2 is an enlarged partial sectional view along line 2-2 in FIG. 1.
Figure 3:
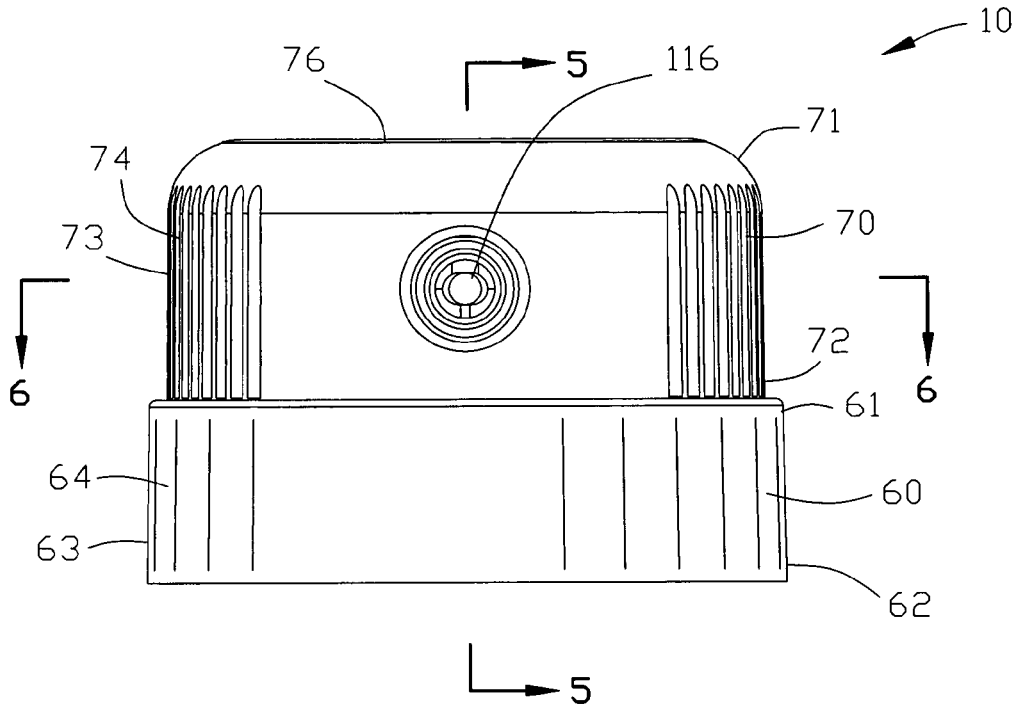
FIG. 3 is an enlarged front view of the improved actuator of FIG. 1.
Figure 4:
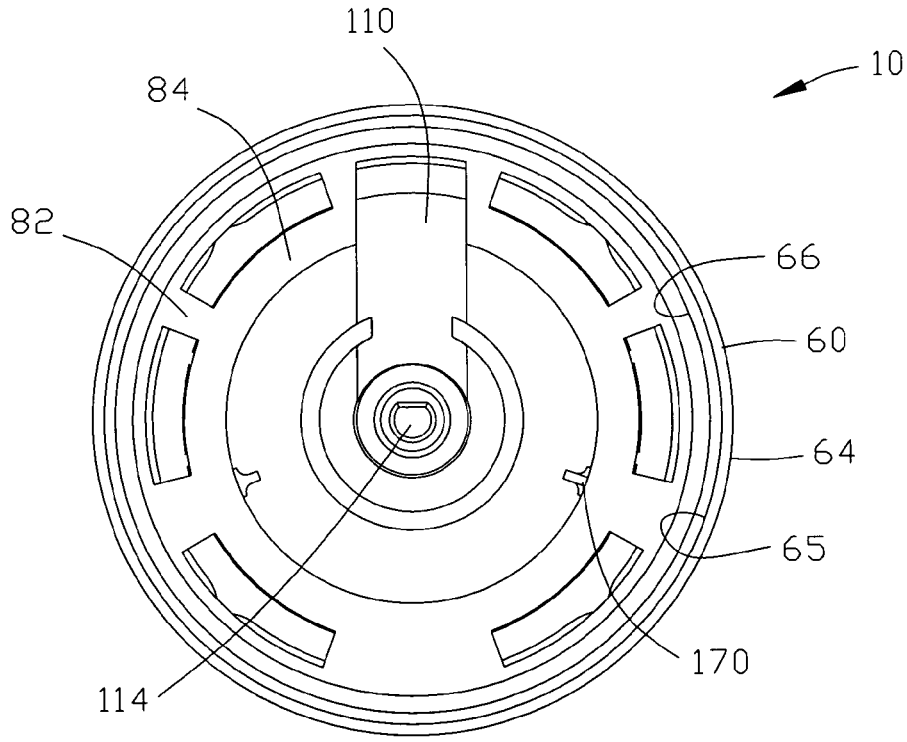
FIG. 4 is a bottom view of FIG. 3.
Figure 5:
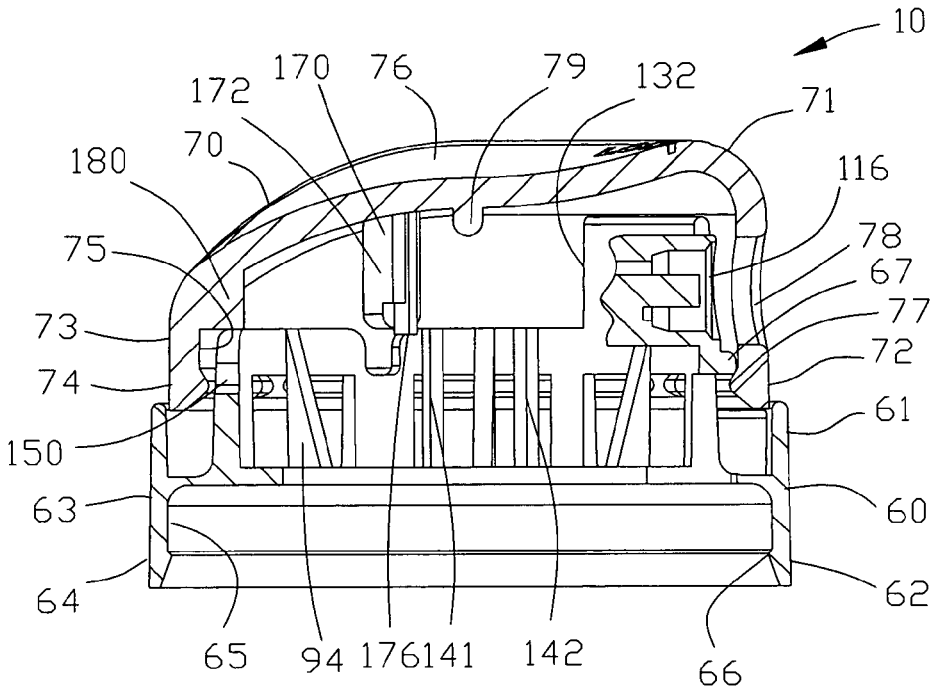
FIG. 5 is a sectional view along line 5-5 in FIG. 3.
Figure 6:
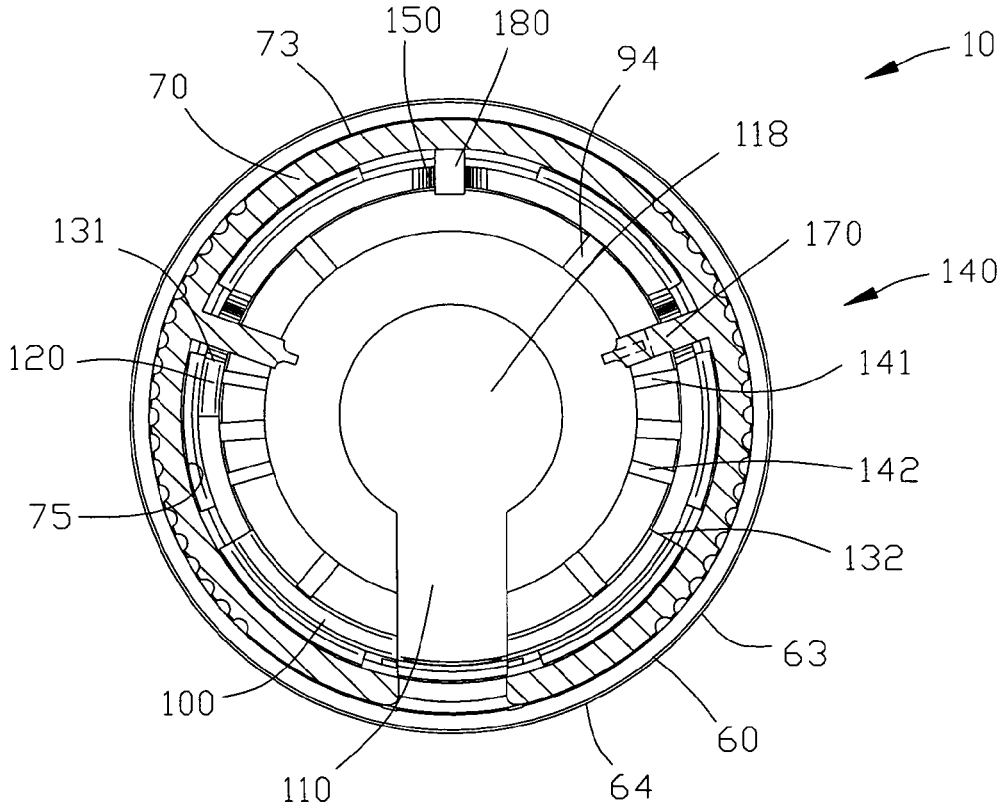
FIG. 6 is a sectional view along line 6-6 in FIG. 3.
Figure 7:
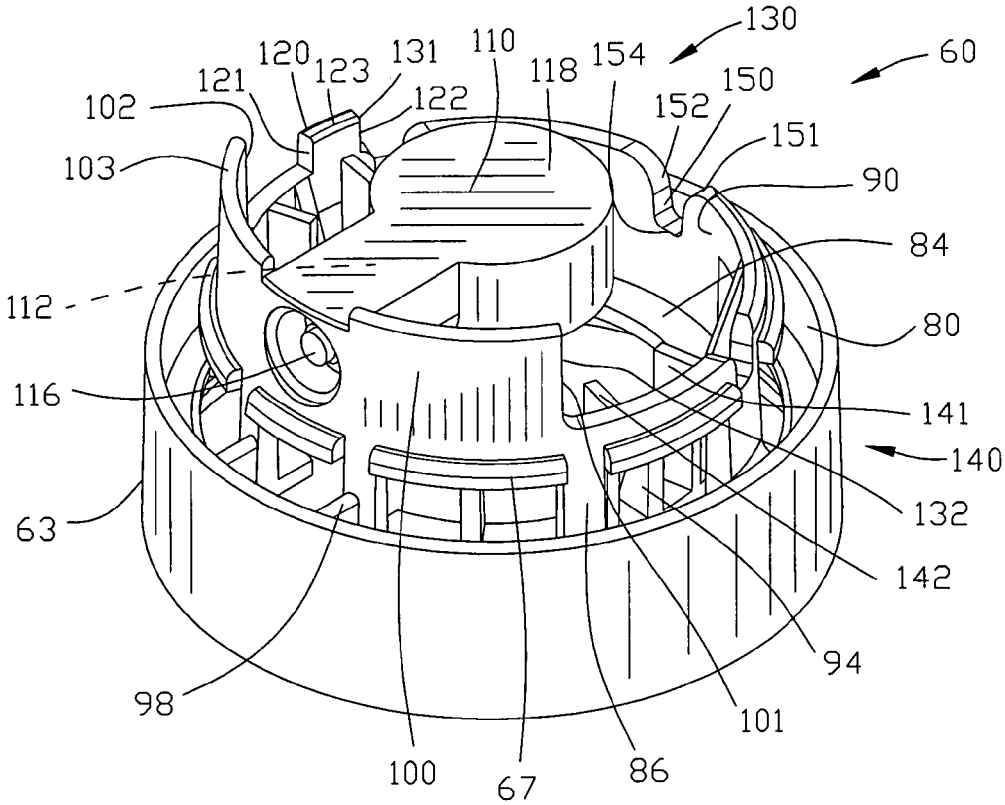
FIG. 7 is a top isometric view of a base portion of the improved actuator of FIGS. 1-6.
Figure 8:
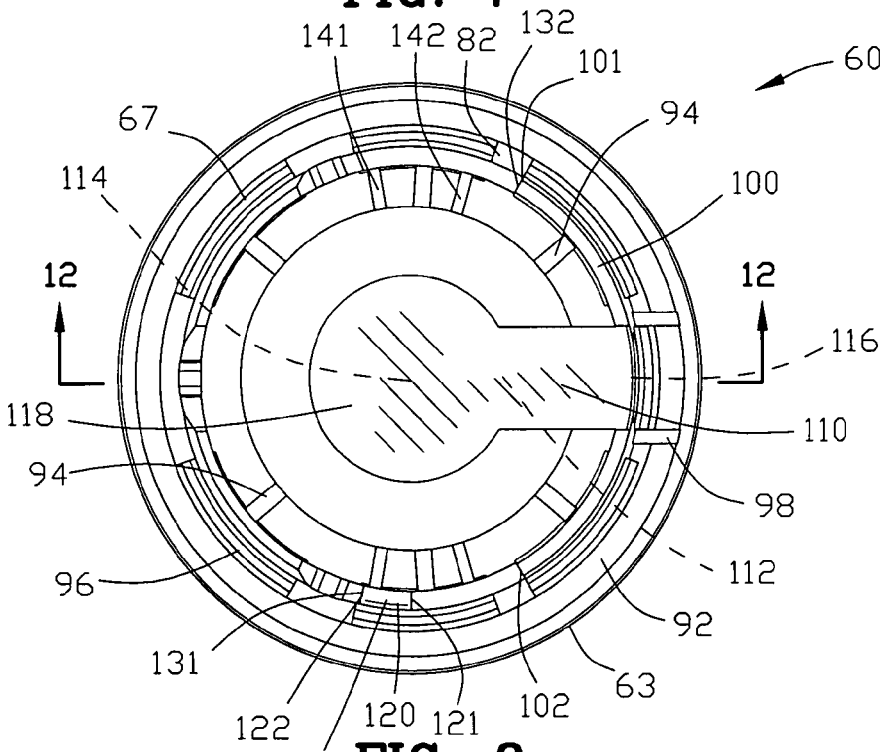
FIG. 8 is a top view of the base shown in of FIGS. 1-6.
Figure 9:
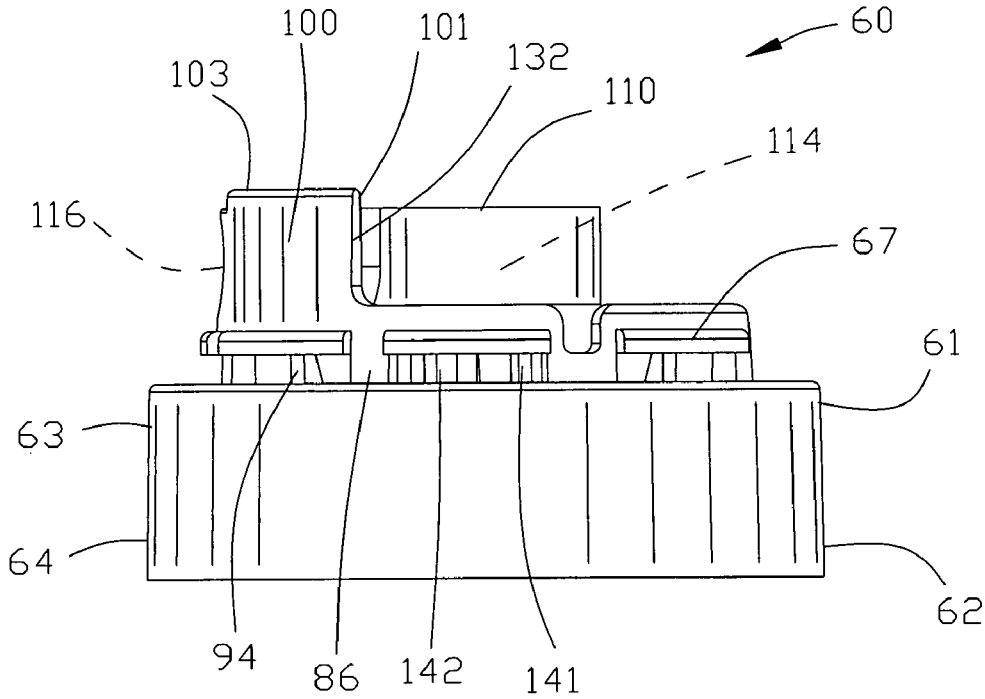
FIG. 9 is a left side view of the base of FIG. 7.
Figure 10:
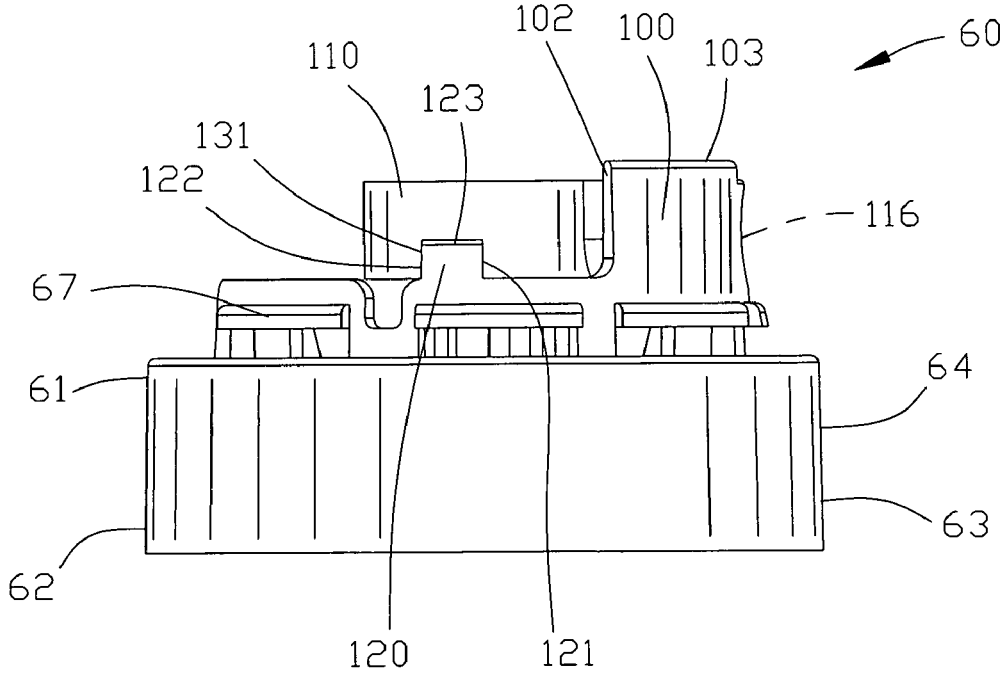
FIG. 10 is a right side view of the base of FIG. 7.
Figure 11:
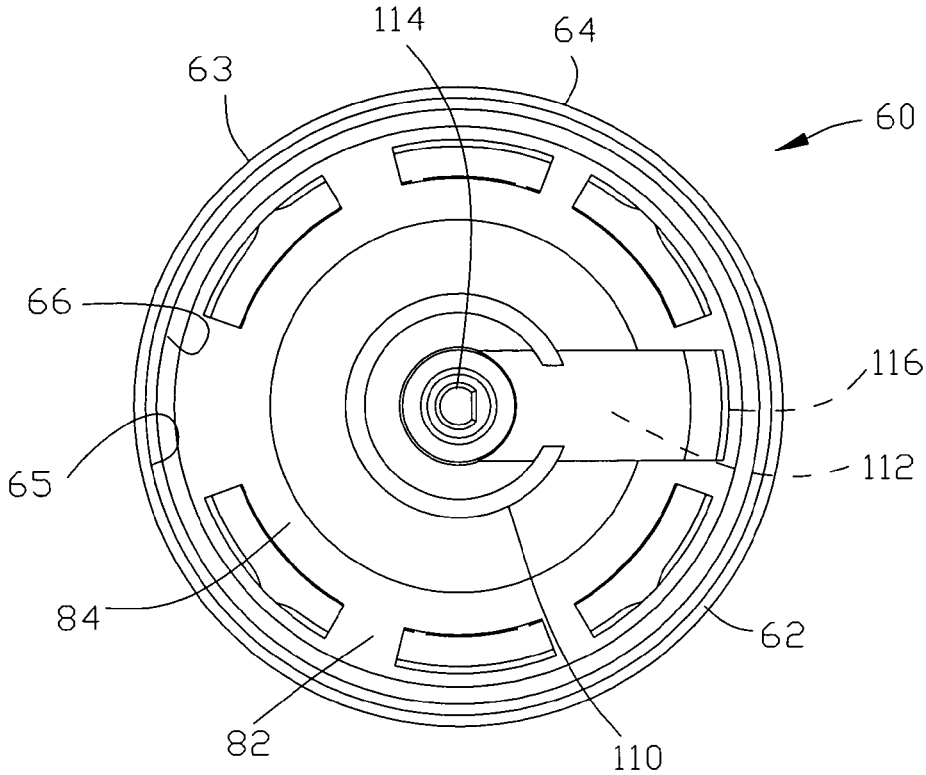
FIG. 11 is a bottom view of FIG. 8.
Figure 12:
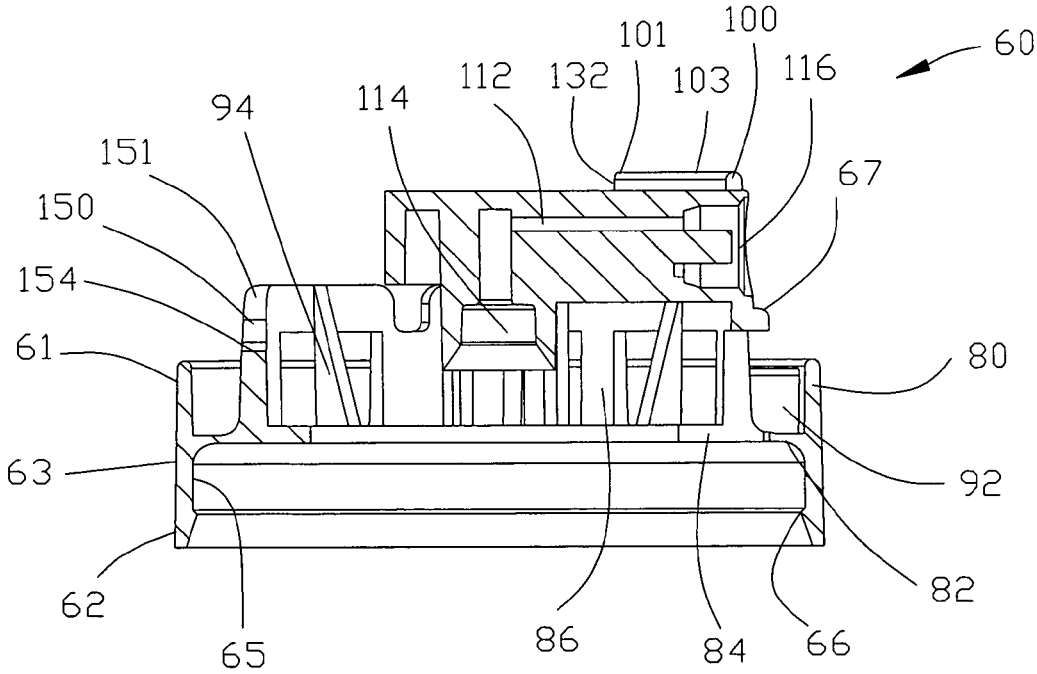
FIG. 12 is a sectional view along line 12-12 in FIG. 8.
Figure 13:
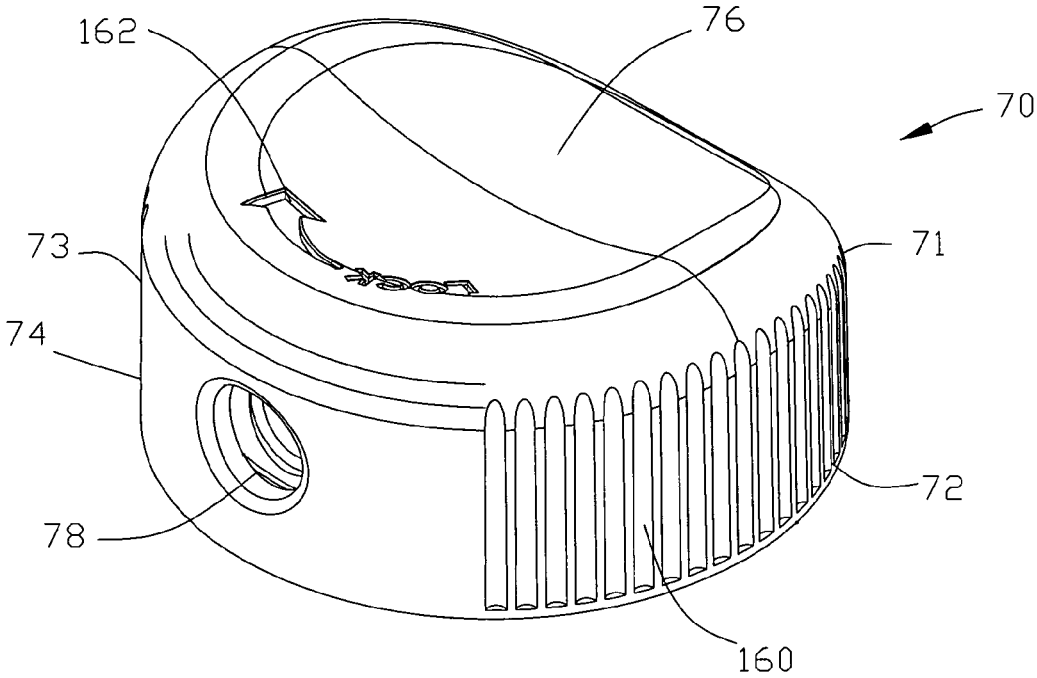
FIG. 13 is a top isometric view of the actuator button of FIGS. 1-6.
Figure 14:
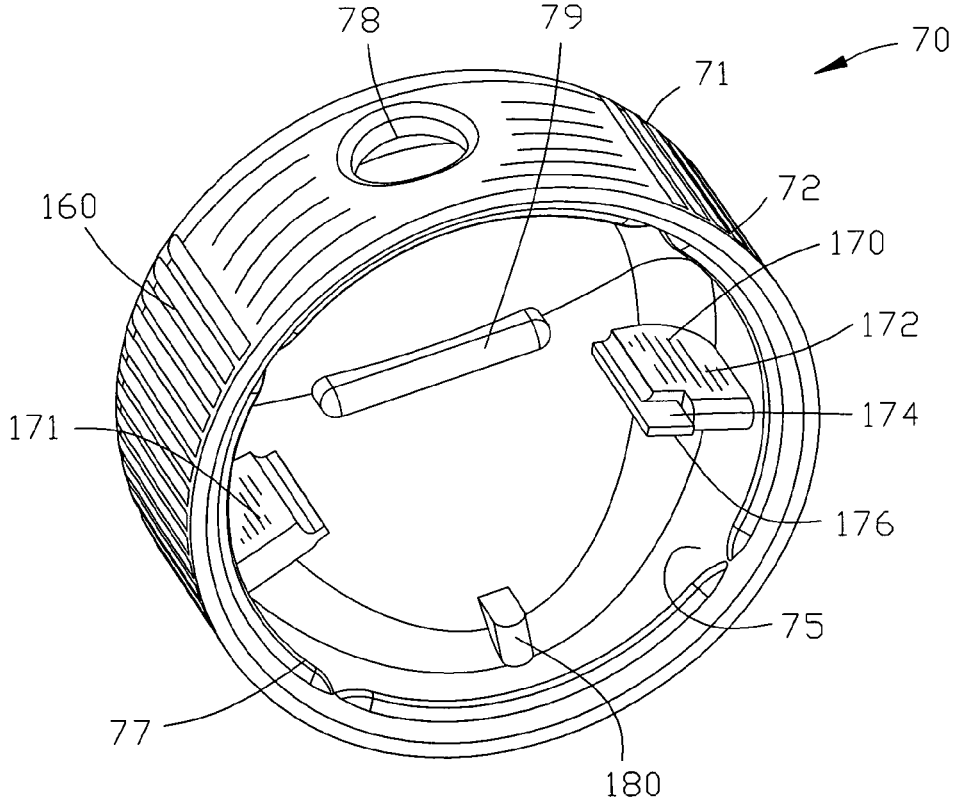
FIG. 14 is a bottom isometric view of the actuator button of FIGS. 1-6.

FIGS. 1 and 2 illustrate a first embodiment of the improved actuator 10 of the present invention for dispensing an aerosol product 11 with an aerosol propellant 12. The first embodiment of the improved actuator 10 defines an axis of symmetry 13. An aerosol valve 20 controls the flow of the aerosol product 11 through a valve stem 30. The aerosol product 11 and the aerosol propellant 12 are stored within an aerosol container 40. The aerosol propellant 12 may be any of the propellants used for aerosol dispensers including liquefied propellants such as hydrocarbons and hydroflouorocarbons and any of the compressed gases such as carbon dioxide or nitrogen or any other suitable compressed gas.

The aerosol container 40 is shown as a small aluminum cylindrical container of conventional design and material. Although the aerosol container 40 has been shown as a small aluminum cylindrical container of conventional design, it should be understood that the improved actuator 10 of the present invention may be used with aerosol containers of various designs.

The aerosol container 40 extends between a top portion 41 and a bottom portion 42 with a cylindrical sidewall 43 located therebetween. The bottom portion 42 of the aerosol container 40 is closed by an endwall 44. The top portion 41 of the aerosol container 40 tapers radially inwardly into a neck 45 terminating in a bead 46. The bead 46 defines an opening 47 in the aerosol container 40 for receiving a mounting cup 50.

The mounting cup 50 includes a peripheral rim 52 for sealing to the bead 46 of the aerosol container 40 in a conventional fashion. The mounting cup 50 includes a turret 54 for receiving the aerosol valve 20.

The aerosol valve 20 includes a valve body 22 secured to the turret 54 of the mounting cup 50 in a conventional fashion.

The valve body 22 defines an internal valve cavity 24 in fluid communication with the aerosol container 40 through a dip tube 26. The aerosol valve 20 includes a valve element 28 positioned within the internal valve cavity 24. A bias spring 29 biases the valve element 28 into a closed position to inhibit the flow of the aerosol product 11 through the valve stem 30.

The valve stem 30 extends between a first end 31 and a second end 32. The valve stem 30 defines an outer surface 33 with a stem passageway 34 extending therein. The stem passageway 34 provides fluid communication to the second end 32 of the valve stem 30 from the aerosol valve 20. The first end 31 of the valve stem 30 interacts with the valve element 28 in a conventional manner. A depression of the valve stem 30 moves the valve element 28 into an open position against the urging of the bias spring 29 to permit the flow of the aerosol product 11 from the second end 32 of the valve stem 30.

Figure 19:
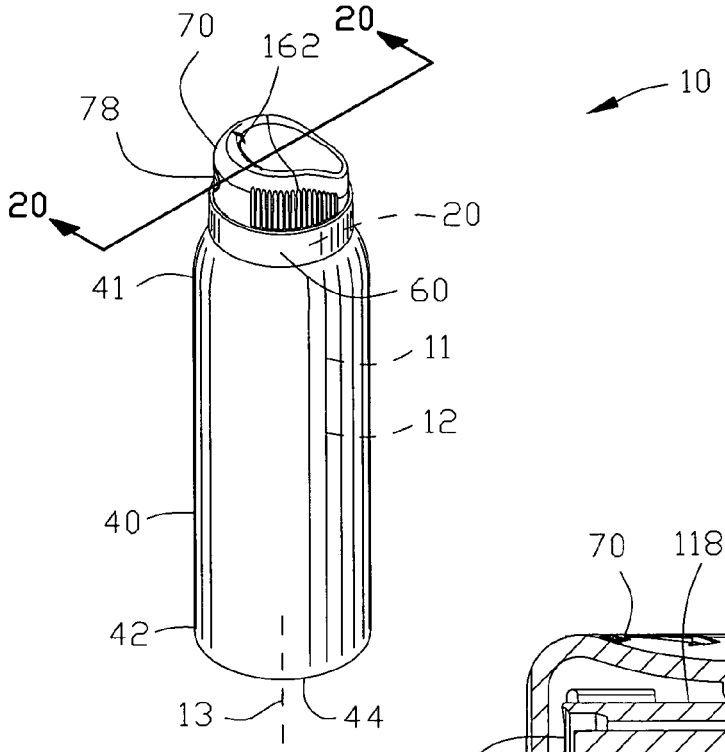
FIG. 19 is a top isometric view similar to FIG. 1 with the actuator button being located in a locked rotational position.
Figure 20:
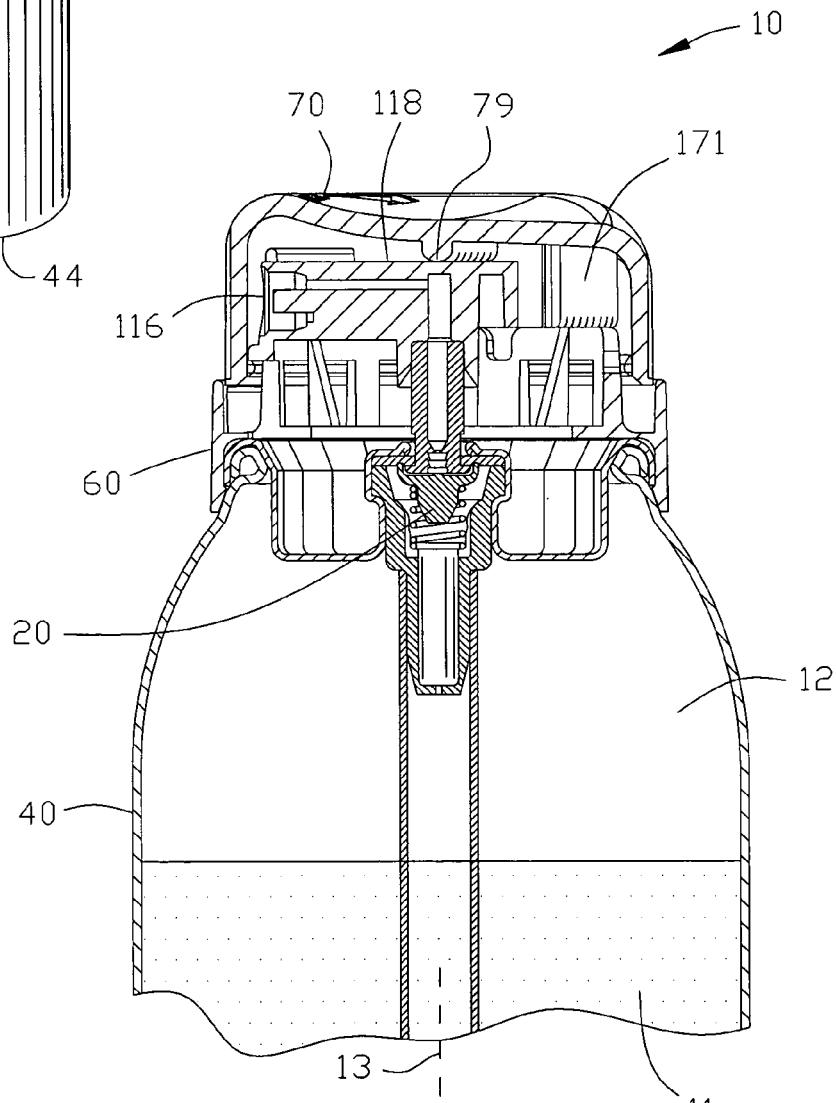
FIG. 20 is an enlarged partial sectional view along line 20-20 in FIG. 19.
Figure 21:
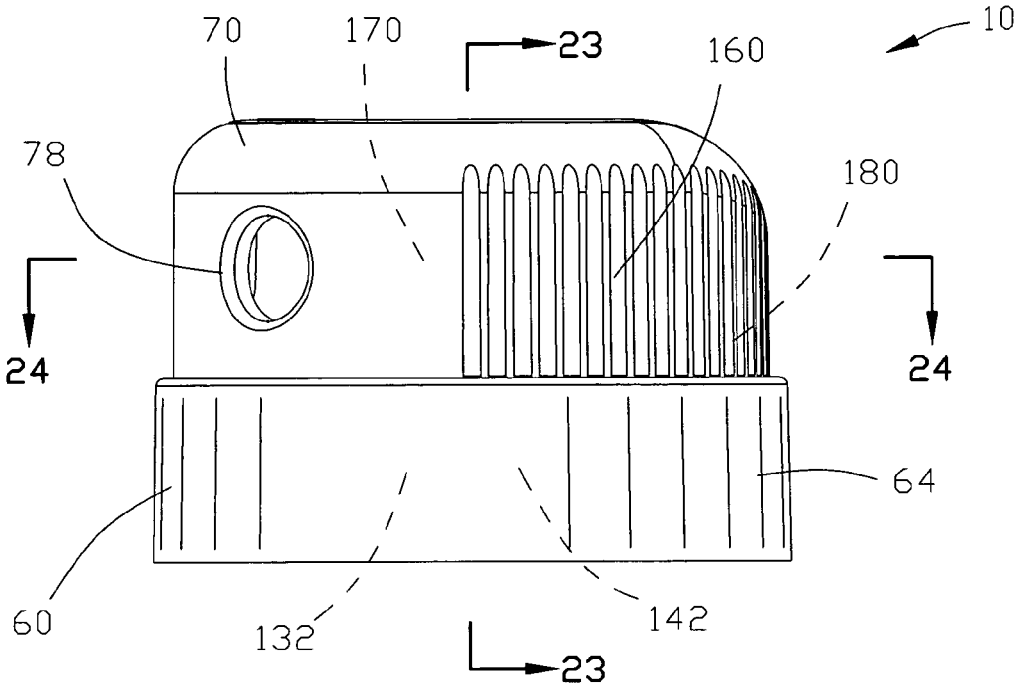
FIG. 21 is an enlarged front view of the improved actuator of FIG. 20.
Figure 22:
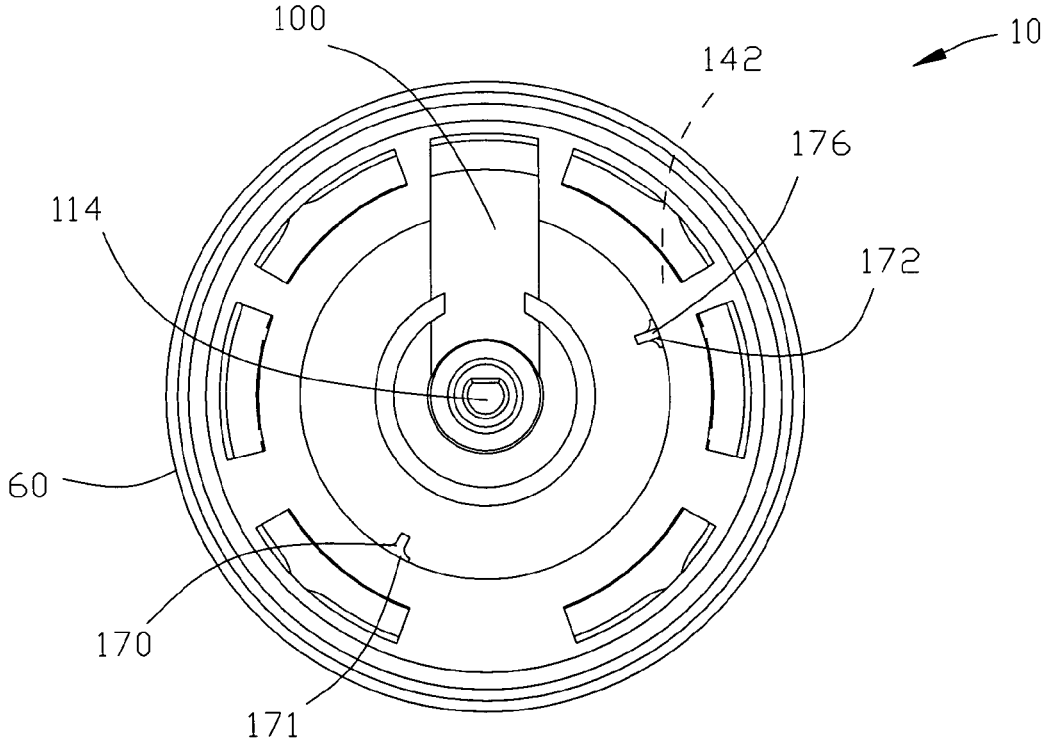
FIG. 22 is a bottom view of FIG. 21.
Figure 23:
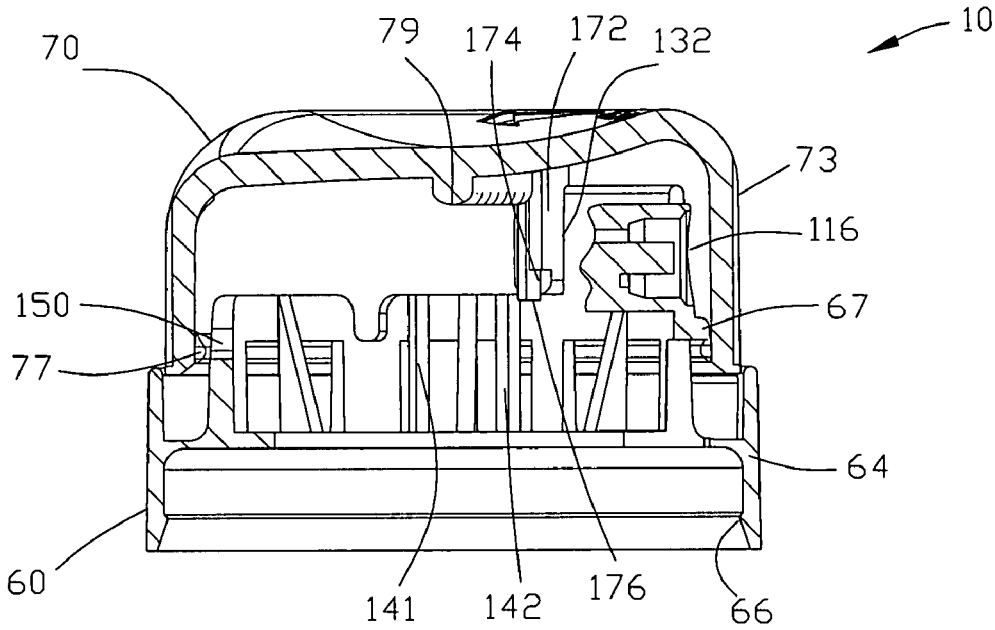
FIG. 23 is a sectional view along line 23-23 in FIG. 21.
Figure 24:
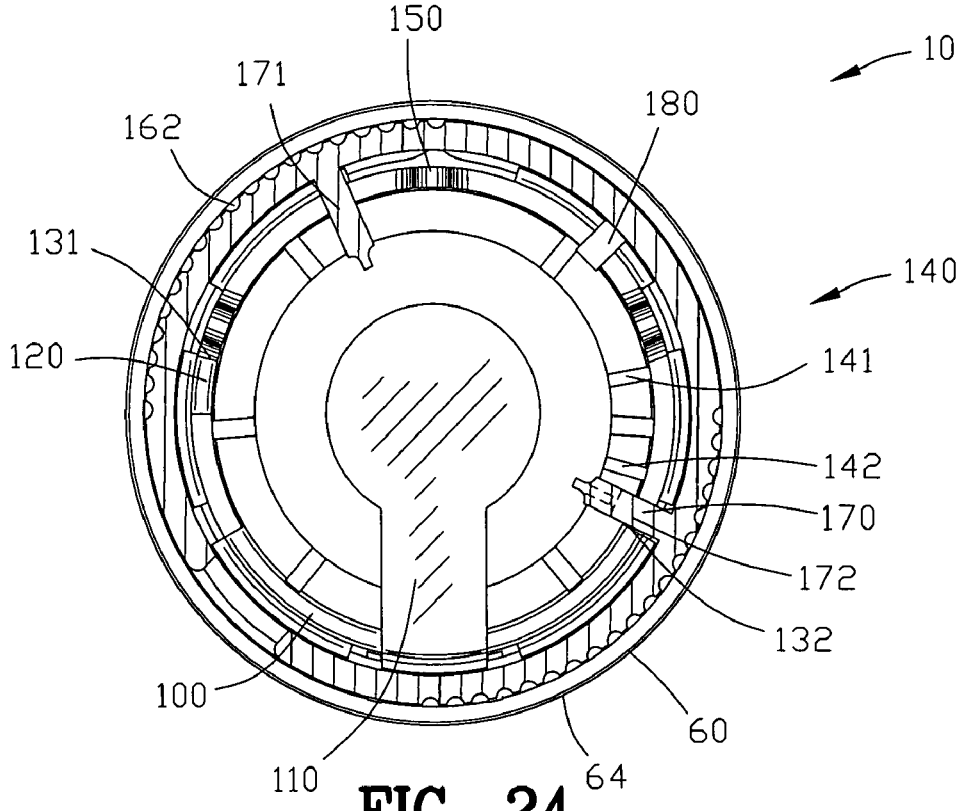
FIG. 24 is a sectional view along line 24-24 in FIG. 21.
Figure 25:
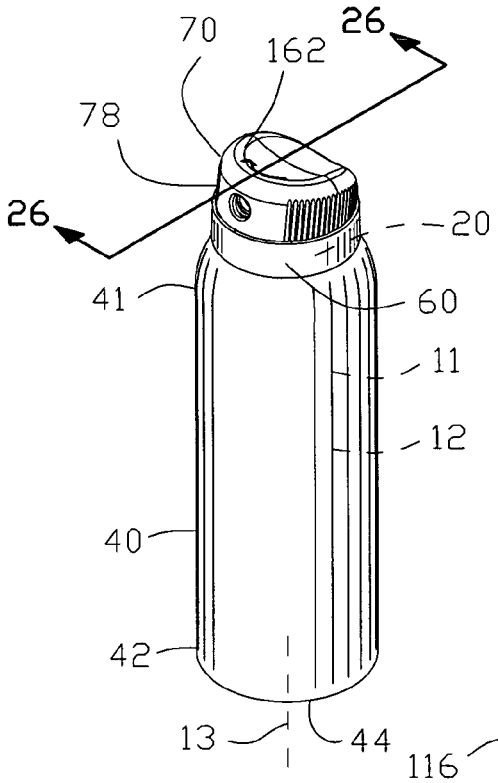
FIG. 25 is a top isometric view similar to FIG. 1 with the actuator button being located in an unlocked rotational position and in an actuated position.
Figure 26:
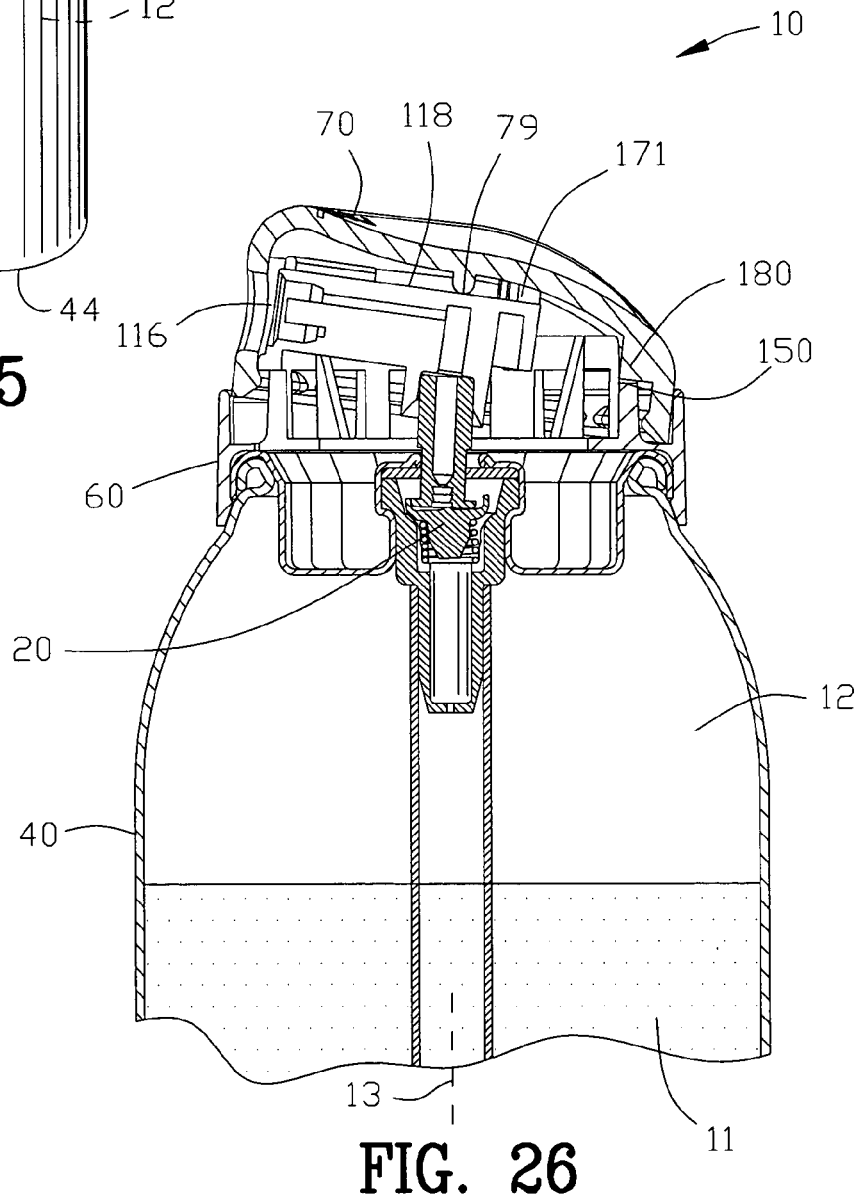
FIG. 26 is an enlarged partial sectional view along line 26-26 in FIG. 25.
Figure 27:
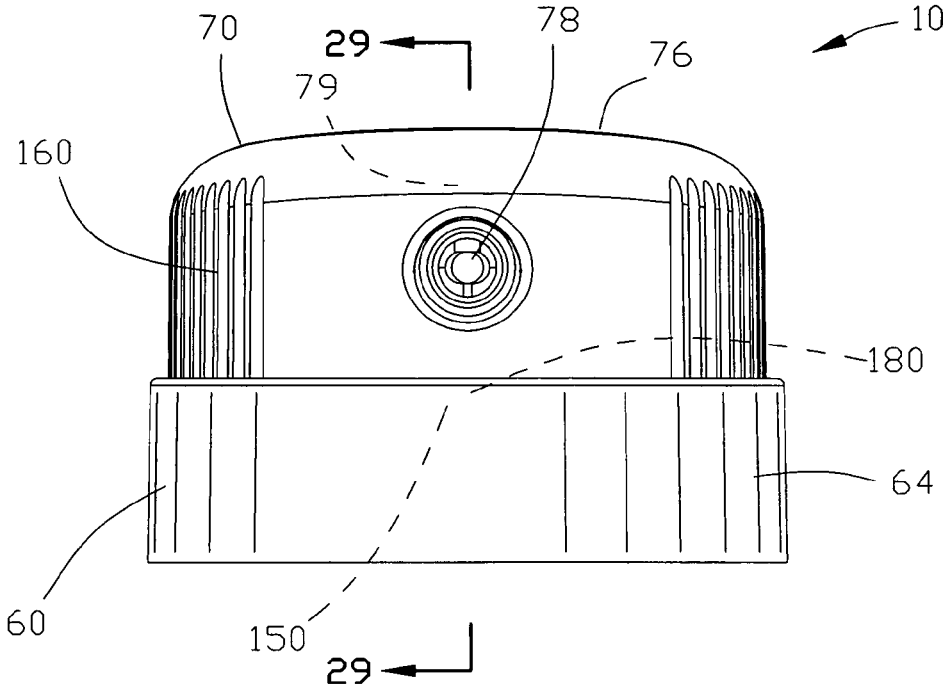
FIG. 27 is an enlarged front view of the improved actuator of FIG. 25.
Figure 28:
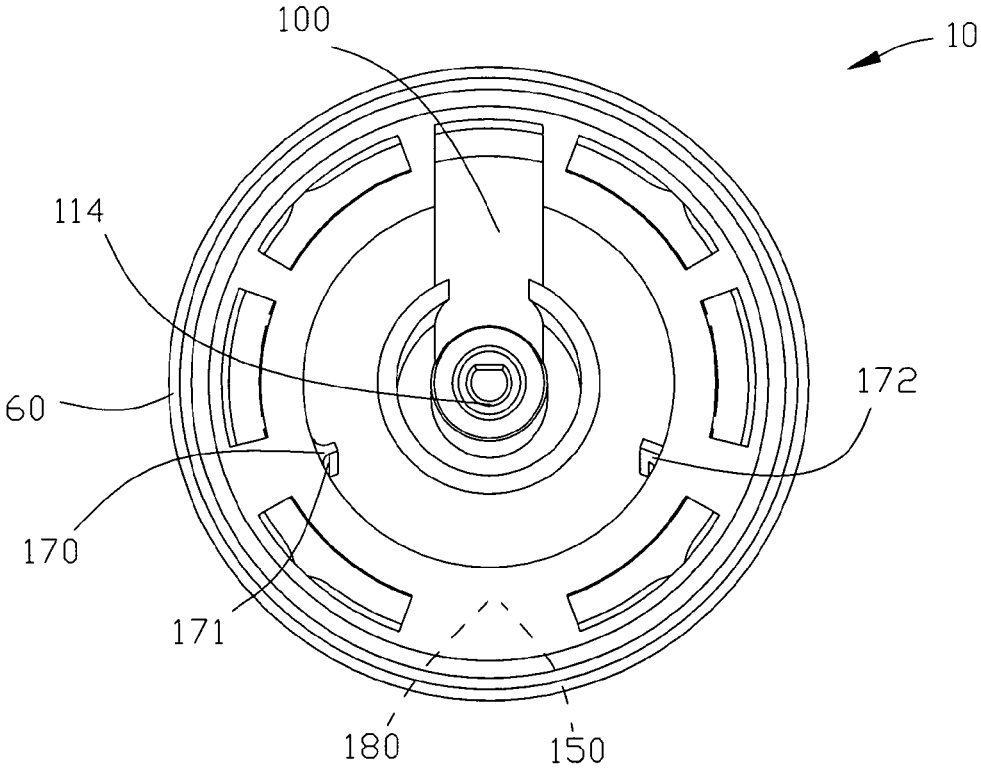
FIG. 28 is a bottom view of FIG. 27.
Figure 29:
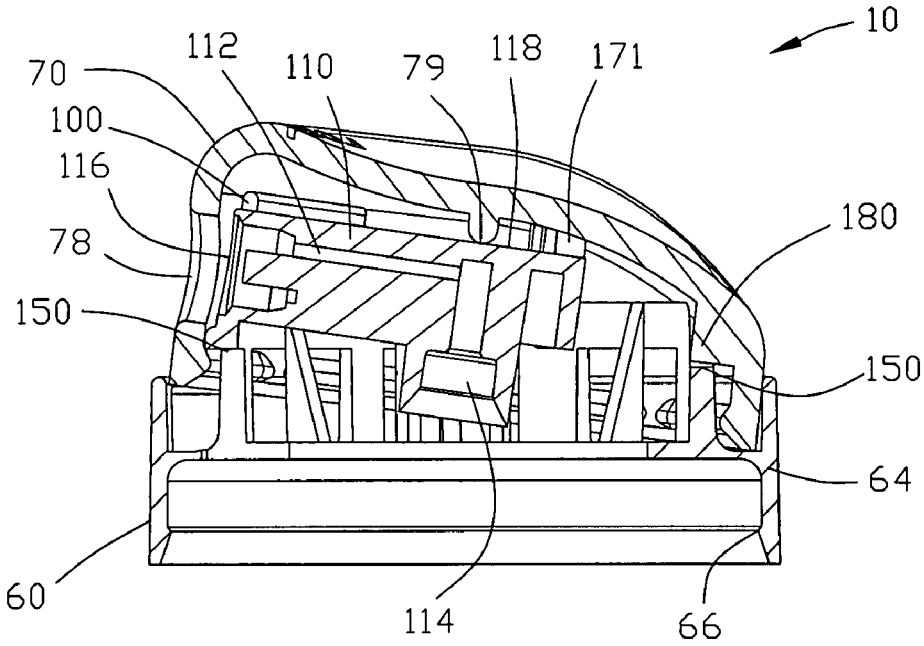
FIG. 29 is a sectional view along line 29-29 in FIG. 27.
Figure 30:
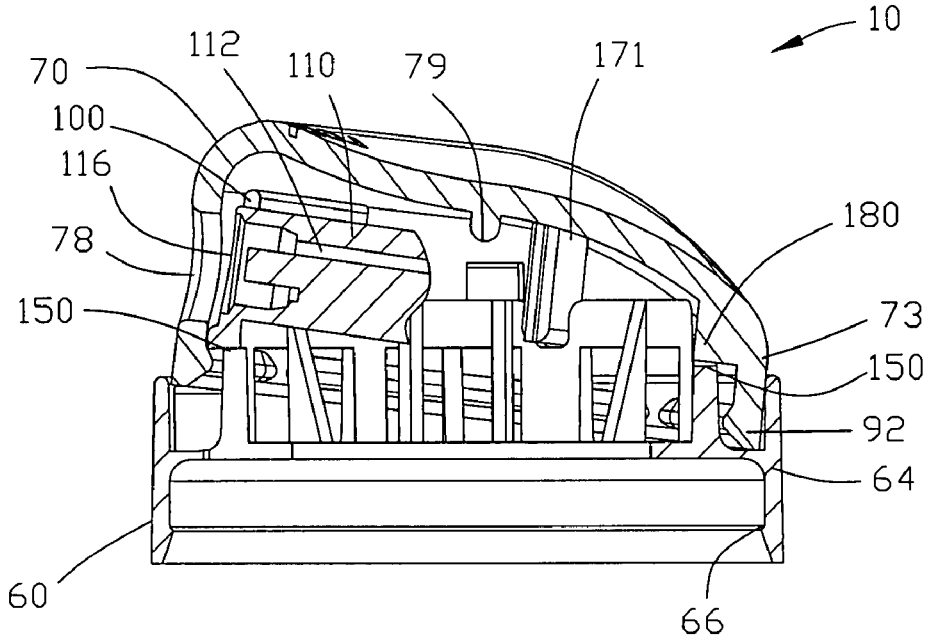
FIG. 30 is a sectional view similar to FIG. 29 with a portion of the nozzle being removed for the purpose of illustration.

FIGS. 3-6 are enlarged views of the improved actuator 10 of FIGS. 1 and 2. The improved actuator 10 comprises a base 60 and an actuator button 70. As will be described in greater detail hereinafter, the actuator button 70 is rotatable relative to the base 60 between an unlocked rotational position as shown in FIGS. 1 and 2 and a locked rotational position as shown in FIGS. 19 and 20. The actuator button 70 is movable or tiltable relative to the base 60 as shown in FIG. 26 for actuating the aerosol valve 20 to dispense the aerosol product 11 from the aerosol container 40 when the actuator button 70 is rotated into the unlocked rotational position as shown in FIGS. 1 and 2. The actuator button 70 inhibited from moving or tilting relative to the base 60 as shown in FIG. 20 when the actuator button 70 is moved into the locked rotational position as shown in FIGS. 19 and 20.

The base 60 extends between a top portion 61 and a bottom portion 62 with a cylindrical sidewall 63 located therebetween. The sidewall 63 of the base 60 defines an outer surface 64 and an inner surface 65 coaxial with the axis of symmetry 13 of the actuator 10. The base 60 includes a base mounting 66 for securing the base 60 to the aerosol container 40. The base mounting 66 is shown as a generally annular base projection 66 extending radially inwardly from the inner surface 65 of the base 60 for securing the base 60 to the aerosol container 40. In this example, the base projection 66 engages with the peripheral rim 52 of the mounting cup 50 and/or the bead 46 of the aerosol container 40 in a snap locking engagement. However, it should be understood that the base projection 66 may engage with an annular seam of a conventional larger diameter aerosol container as shown in FIGS. 30-60.

The base 60 includes a base retainer 67 for rotationally securing the actuator button 70 to the base 60. The base retainer 67 comprises a plurality of annular projections 67 extending radially outwardly from the base 60. The plurality of annular projections 67 are distributed about the axis of symmetry 13 of the aerosol actuator 10.

The actuator button 70 is shown as unitary actuator button 70 extending between a top portion 71 and a bottom portion 72 with a cylindrical sidewall 73 located therebetween. The sidewall 73 of the actuator button 70 is a substantially rigid sidewall 73 defining an outer surface 74 and an inner surface 75 coaxial with the axis of symmetry 13 of the actuator 10. The substantially rigid sidewall 73 of the actuator button 70 supports a rigid top actuating surface 76.

The actuator button 70 includes a button retainer 77 for cooperating with the base retainer 67 for rotationally securing the actuator button 70 to the base 60. The button retainer 77 is shown as a plurality of annular projection 77 extending radially inwardly from the inner surface 75 of the sidewall 73 of the actuator button 70. The radially inwardly extending button retainers 77 cooperate with the radially outwardly extending button retainers 67 for rotationally securing the actuator button 70 to the base 60.

The actuator button 70 includes an actuator surface 79 extending from the rigid top actuating surface 76. Preferably, the actuator button 70 is formed of a unitary substantially rigid material for enabling the entirety of the actuator button 70 to tilt as a unit relative to the base 60.

FIGS. 7-12 illustrate various views of the base 60 shown in FIGS. 3-6. The first end 61 of the base 60 defines an outer ring 80. The outer ring 80 is a substantially cylindrical upper portion of the cylindrical sidewall 63. A plurality of radial ribs 82 extend radially inwardly from the inner surface 65 of the cylindrical sidewall 63. The plurality of radial ribs 82 supports base ring 84. The base ring 84 is coaxial with the axis of symmetry 13 of the actuator 10.

A plurality of axial ribs 86 extend axially upwardly from the base ring 84. The plurality of axial ribs 86 extend substantially parallel to and are spaced about the axis of symmetry 13 of the actuator 10. The plurality of axial ribs 86 support an inner ring 90. The inner ring 90 is coaxial with the outer ring 80 forming an annular void 92 therebetween. A plurality of triangularly shaped supporting ribs 94 provide additional support to the inner ring 90 from the base ring 84.

The inner ring 90 includes the base retainer 67 for cooperating with the button retainer 77 for rotationally securing the actuator button 70 to the base 60. The base retainer 67 is shown as a generally annular projection 67 extending radially outwardly from the inner ring 90 of the base 60. Preferably, the inner ring 90 of the base 60 is deformable for enabling the button retainer 77 to pass over the base retainer 67. After the button retainer 77 passes over the base retainer 67, the base retainer 67 engages with the button retainer 77 to retain the actuator button 70 on the base 60. The button retainer 77 of the actuator button 70 interlocks with the base retainer 67 for rotationally securing the actuator button 70 to the base 60.

A bridge 98 extends across the void 92 between the outer ring 80 and the inner ring 90 of the base 60. The bridge 98 extends across a first portion of the inner ring 90 in proximity to the level of the first end 61 of the base 60. The bridge 98 occupies a minor portion of the circumference of the inner ring 90. In this example, the bridge 98 occupies a five to ten degree arc portion of the circumference of the inner ring 90 about the axis of symmetry 13 of the actuator 10.

A flexible wall 100 extends upwardly from the inner ring 90 of the base 60. Preferably, the flexible wall 100 is integrally formed with the inner ring 90 of the base 60. The flexible wall 100 comprises a flexible partially cylindrical wall 100 extending about the axis of symmetry 13 of the actuator 10. The flexible partially cylindrical wall 100 is bounded by a first and a second edge 101 and 102 and a top surface 103.

A nozzle 110 defines a nozzle channel 112 extending between a socket 114 and a terminal orifice 116. The socket 114 is adapted to fractionally receive the second end 32 of the valve stem 30. The nozzle 110 includes a nozzle actuating surface 118 located above the socket 114. The terminal orifice 116 may optionally receive a terminal orifice insert (not shown) for controlling the spray pattern and/or the spray characteristics of the aerosol product 11 being discharged from the actuator 10.

The nozzle 110 is secured to the flexible wall 100 for enabling the nozzle 110 to pivot about the flexible wall 100 upon the flexing or deformation of the flexible wall 100. Preferably, the nozzle 110 is located directly adjacent to the bridge 98 extending across the void 92 between the outer ring 80 and the inner ring 90 of the base 60.

A depression of the nozzle actuating surface 118 enables the nozzle 110 to pivot about the flexible wall 100 to depress the valve stem 30. The depression of the valve stem 30 moves the valve element 28 into an open position to permit the flow of the aerosol product 11 through the stem passage 34 of the valve stem 30 and thorough the nozzle channel 112 of the nozzle 110 for discharge from the terminal orifice 116.

A secondary wall 120 extends upwardly from the inner ring 90 of the base 60. Preferably, the secondary wall 120 is integrally formed with the inner ring 90 of the base 60. The flexible wall 120 is bounded by a first and a second edge 121 and 122 and a top surface 123. In this example, the top surface 103 of the flexible wall 100 extends upwardly a greater distance than the top surface 123 of the secondary wall 120.

Figure 15:
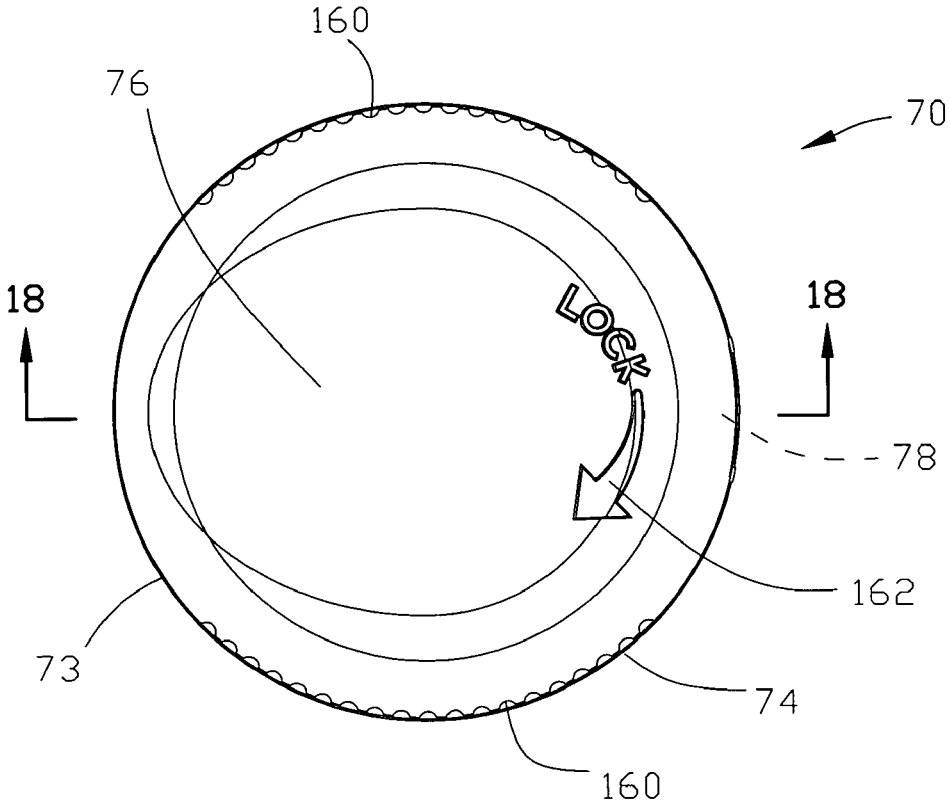
FIG. 15 is a top view of the actuator button of FIGS. 13-14.
Figure 16:
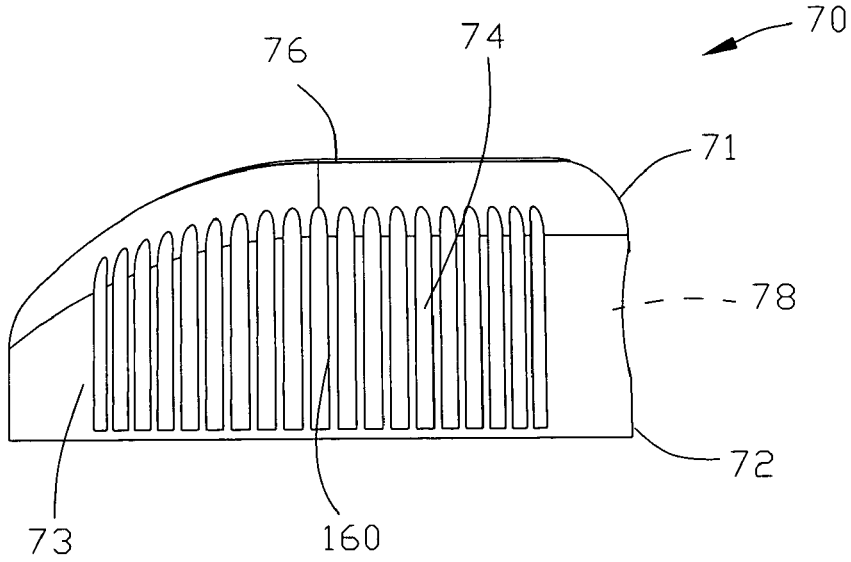
FIG. 16 is a side view of the actuator button of FIG. 15.
Figure 17:
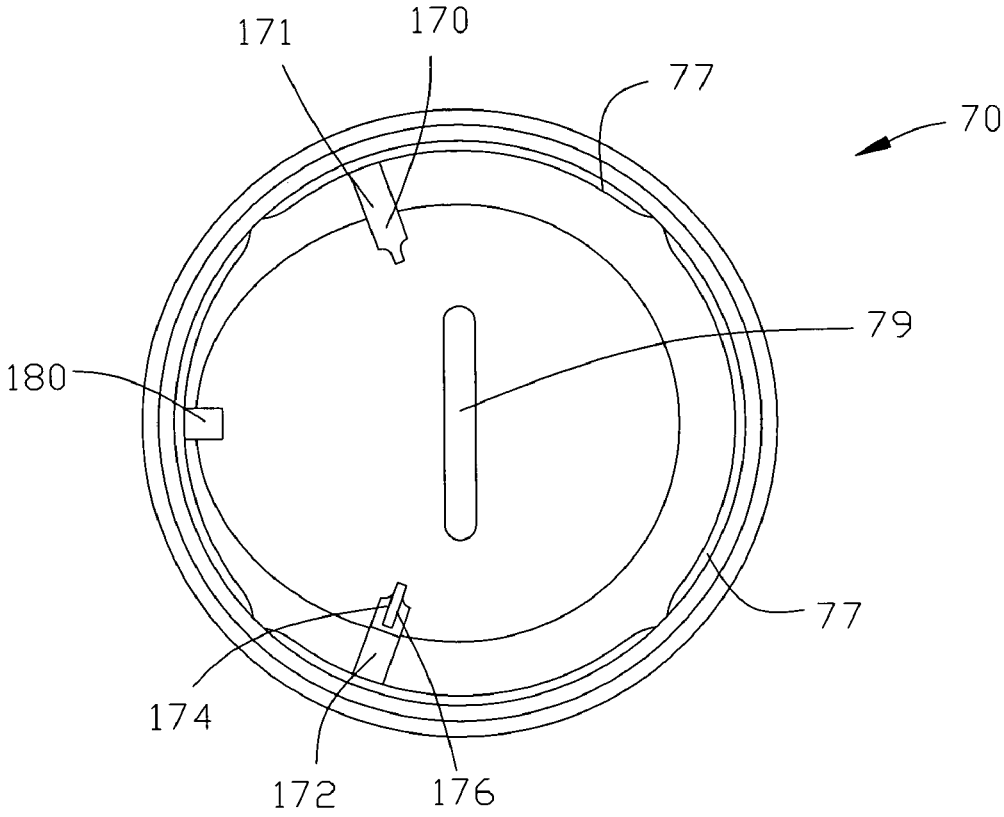
FIG. 17 is a bottom view of FIG. 16.
Figure 18:
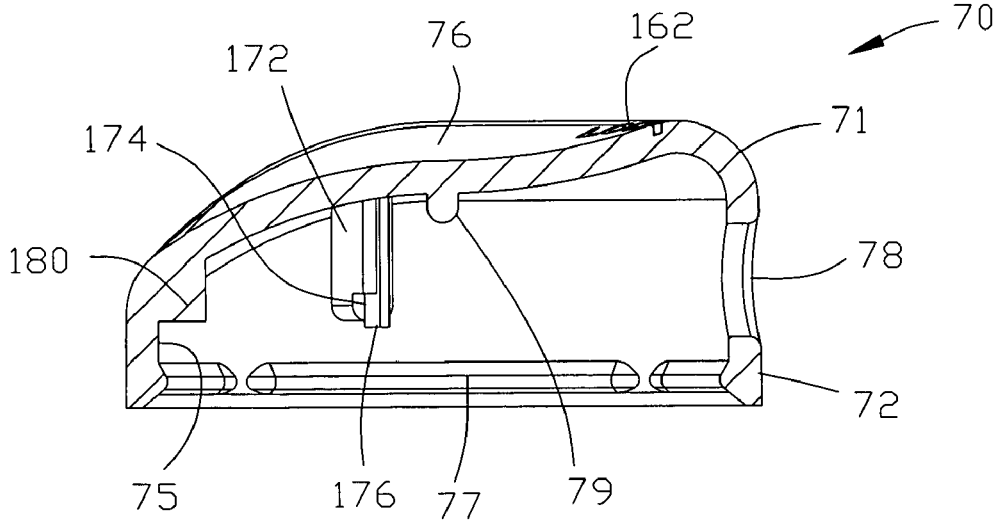
FIG. 18 is a sectional view along line 18-18 in FIG. 15.

The base 60 includes a base stop 130 for cooperating with the actuator button 70 for establishing an unlocked position and a locked rotational position of the actuator button 70 relative to the base 60. More specifically, the base stop 130 includes an unlocked position stop 131 for establishing the unlocked rotational position of the actuator button relative to the base 60 as shown in FIGS. 1 and 2. The base stop 130 includes a locked position stop 132 for establishing the locked rotational position of the actuator button relative to the base 60 as shown in FIGS. 15 and 16.

The base 60 includes audible ribs 140 for cooperating with the actuator button 70 for audibly indicating the unlocked rotational position and the locked rotational position of the actuator button 70 relative to the base 60. More specifically, the audible ribs 140 includes an unlocked audible rib 141 for audibly indicating the unlocked rotational position of the actuator button 70 relative to the base 60 as shown in FIGS. 1 and 2. The audible ribs 140 includes a locked audible rib 142 for audibly indicating the locked rotational position of the actuator button relative to the base 60 as shown in FIGS. 15 and 16.

A groove 150 is defined in the inner ring 90 of the base 60. The groove 150 is located on a second portion of the inner ring 90 opposite the position of the bridge 98 extending across the first portion of the inner ring 90. Preferably, groove 150 has a V-shape formed by tapered sides 151 and 152 terminating in a groove bottom 154.

FIGS. 13-18 illustrate various views of the actuator button 70 shown in FIGS. 1-6. Preferably, the cylindrical sidewall 73 includes knurles 160 for assisting in the rotation of the actuator button 70 relative to the base 60. The top actuating surface 76 of the actuator button 70 may include a rotation indicator 162 for indicating the direction of rotation of the actuator button 70 relative to the base 60 between the unlocked rotational position and the locked rotational position. The actuator surface 79 extends from the rigid top actuating surface 76 of the actuator button 70.

The actuator button 70 includes a button stop 170 for cooperating with a base stop 130 for establishing the unlocked position and the locked rotational position of the actuator button 70 relative to the base 60. In this example, the button stop 170 includes a button position stop 171 and a button position stop 172.

The button position stop 172 is provided with a recess 174 and an extended projection 176. The recess 174 increases the flexibility of the extended projection 176. The extended projection 176 cooperates with the unlocked audible rib 141 and the locked audible rib 142 for audibly indicating the rotational position of the actuator button relative to the base 60.

The actuator button 70 includes a groove rib 180 extending from the inner surface 75 and the rigid top actuating surface 76 of the actuator button 70. Preferably, the groove rib 180 is formed as a one-piece unit of the actuator button 70. As will be described hereinafter, the groove rib 180 is dimensioned for insertion within the groove 150 as defined in the inner ring 90 of the base 60.

FIGS. 19-24 are various views of the improved actuator 10 of FIGS. 1 and 2 with the actuator button 70 being located in the locked rotational position. The actuator button 70 has been rotated clockwise relative to the base 60 until the button position stop 172 of the actuator button 70 engages the locked position stop 132 of the base 60. During the clockwise rotation of the actuator button 70 to the locked rotational position, the extended projection 176 of the button position stop 172 passes over the unlocked and locked audible ribs 141 and 142 to provide two independent audible clicks. The extended projection 176 of the button position stop 172 is maintained in the locked rotational position by the locked audible ribs 142.

When the actuator button 70 is located in the locked rotational position, the terminal orifice 116 of the nozzle is covered by the sidewall 73 of the actuator button orifice 78 of the actuator button 70. The groove rib 180 engages with the inner ring 90 to prevent the actuator surface 79 of the actuator button 70 from depressing the nozzle actuating surface 118. The actuator button 70 is inhibited from tilting relative to the base 60 when the actuator button 70 is moved into the locked rotational position and is likewise inhibited from actuating the aerosol valve 20.

FIGS. 25-30 are various views of the improved actuator 10 of FIGS. 1 and 2 with the actuator button 70 being located in the unlocked rotational position and with the actuator button 70 being in an actuated position.

The actuator button 70 has been rotated counterclockwise relative to the base 60 until the button position stop 171 of the actuator button 70 engages the unlocked position stop 131 of the base 60. During the counter clockwise rotation of the actuator button 70 to the unlocked rotational position, the extended projection 176 of the button position stop 172 passes over the unlocked and locked audible ribs 141 and 142 to provide two independent audible clicks. The extended projection 176 of the button position stop 172 is maintained in the unlocked rotational position by the unlocked audible ribs 141.

When the actuator button 70 is located in the unlocked rotational position, the terminal orifice 116 of the nozzle is aligned with the actuator button orifice 78 of the actuator button 70. The groove rib 180 is aligned with the groove 150 defined in the inner ring 90 of the base 60.

A depression of the top actuating surface 76 by an operator causes the total actuator button 70 to tilt about the bridge 98 extending across a first portion of the inner ring 90. The actuator button 70 tilts in its entirety as a unit relative to the base 60 as the groove rib 180 enters the groove 150 defined in the inner ring 90 of the base 60. A portion of the sidewall 73 of the actuator button 70 enters the void 92 between the outer ring 80 and the inner ring 90.

The tilting of the actuator button 70 causes the actuator surface 79 to depress the nozzle actuating surface 118 to actuate the aerosol valve 20. The actuator button 70 is tiltable relative to the base 60 for actuating the aerosol valve 20 to dispense the aerosol product 11 from the aerosol container 40 for discharge through the terminal orifice 116 when the actuator button 70 is rotated into the unlocked rotational position.

Figure 31:
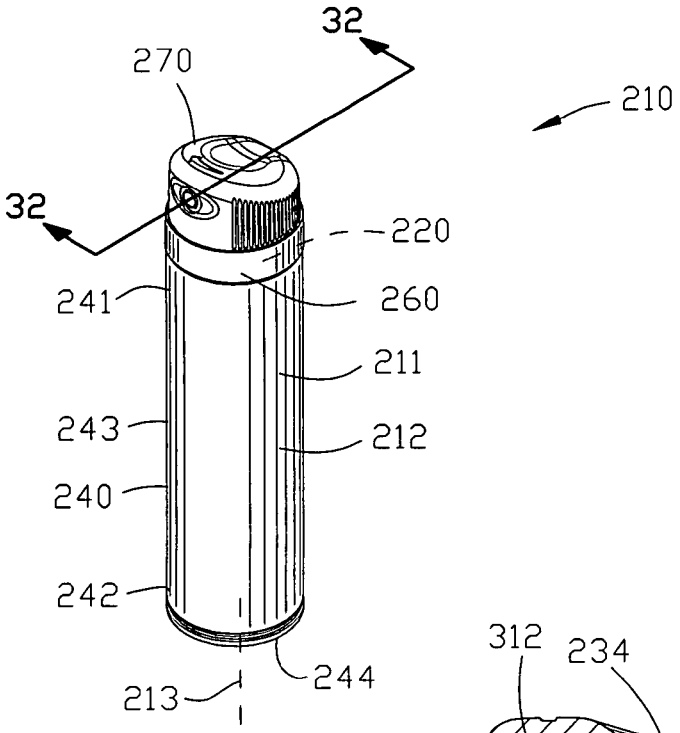
FIG. 31 is a top isometric view of a second embodiment of the improved actuator of the present invention located on an aerosol container.
Figure 32:
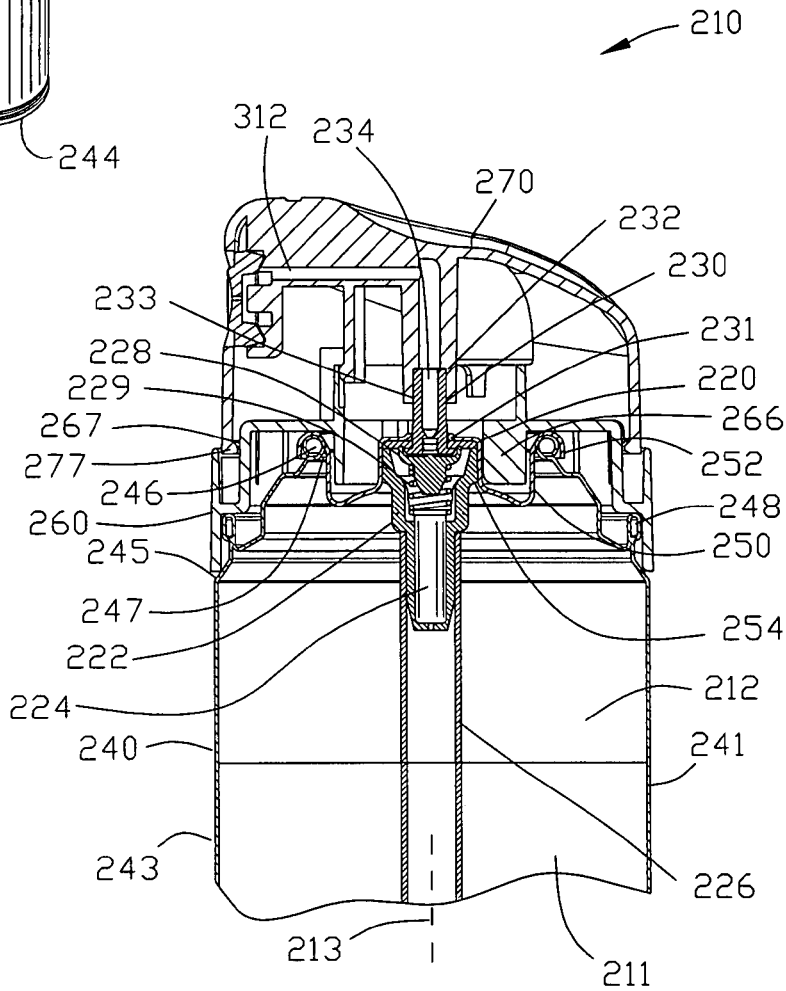
FIG. 32 is an enlarged partial sectional view along line 32-32 in FIG. 31.
Figure 33:
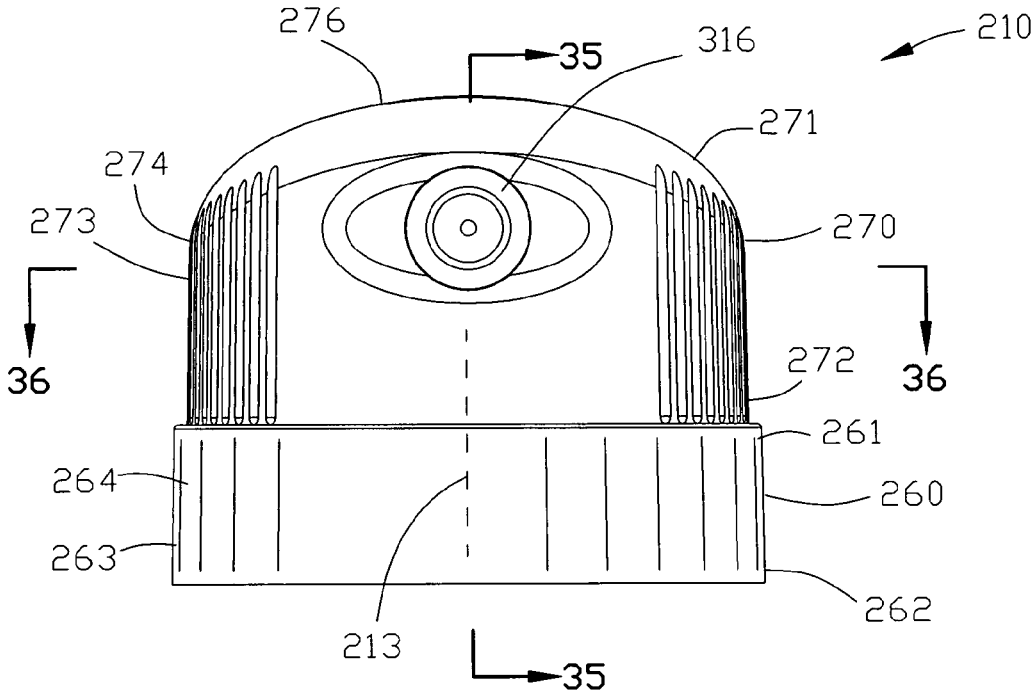
FIG. 33 is an enlarged front view of the improved actuator of FIG. 31.
Figure 34:
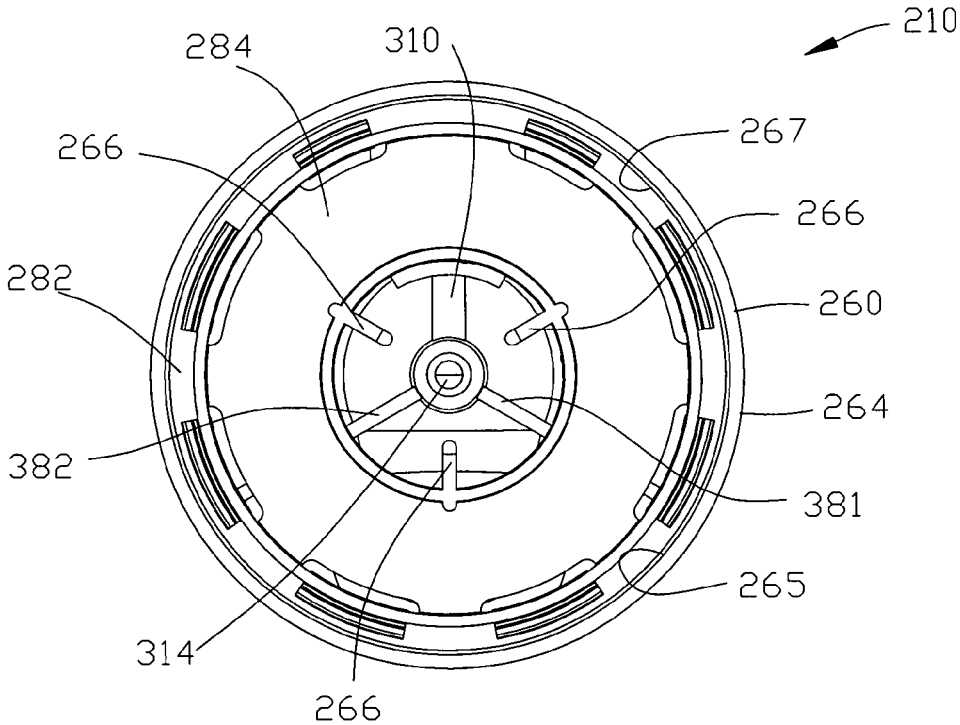
FIG. 34 is a bottom view of FIG. 33.
Figure 35:
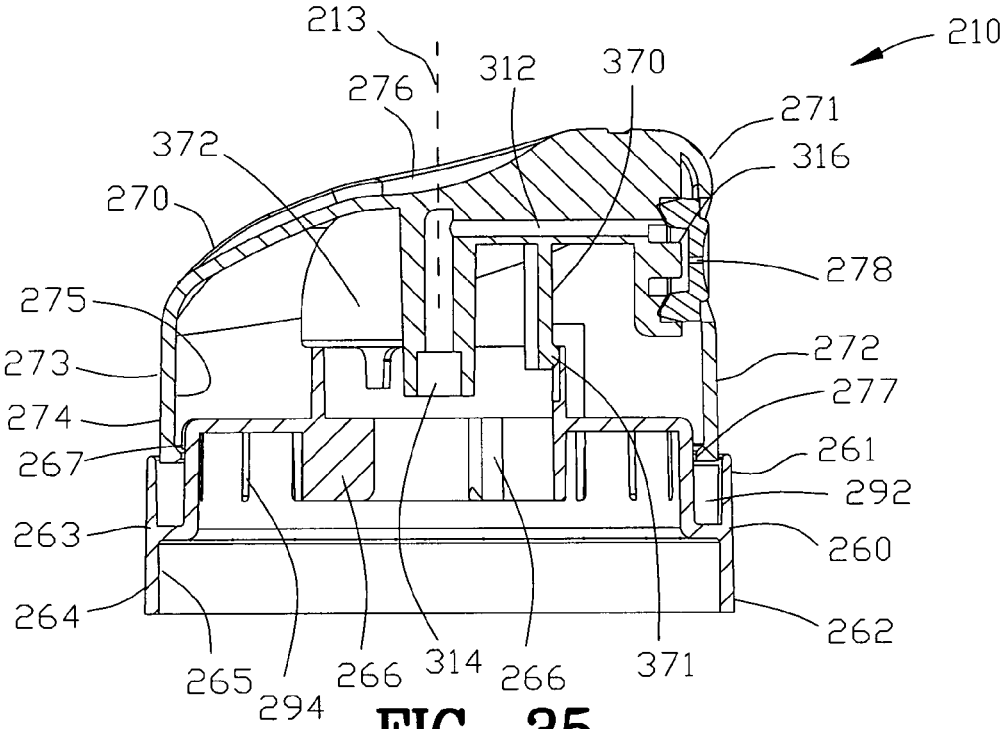
FIG. 35 is a sectional view along line 35-35 in FIG. 33.
Figure 36:
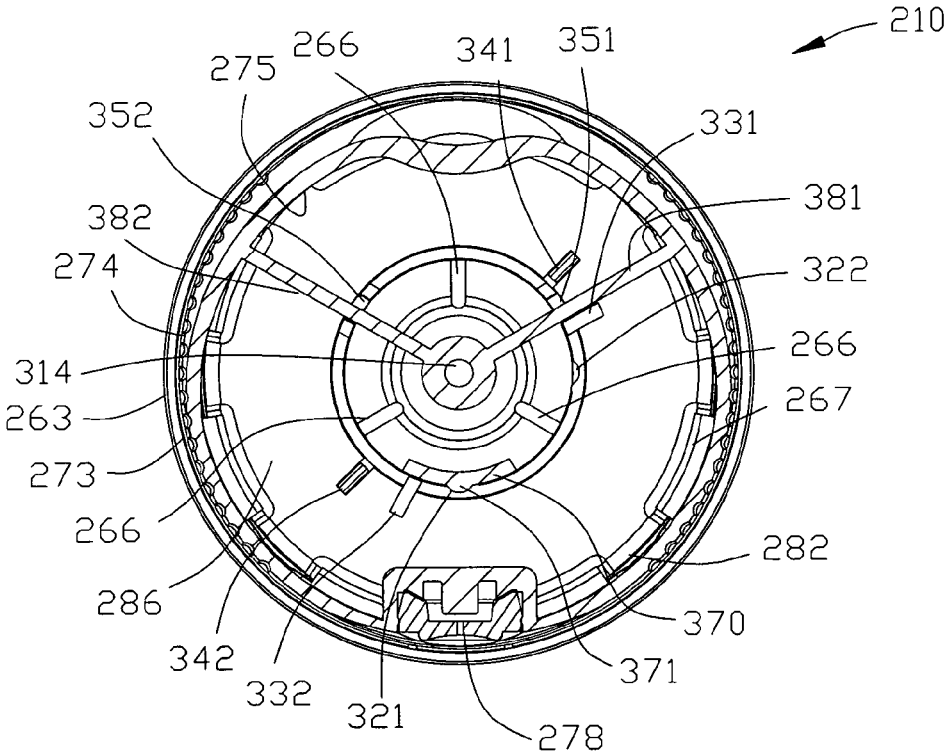
FIG. 36 is a sectional view along line 36-36 in FIG. 33.
Figure 37:
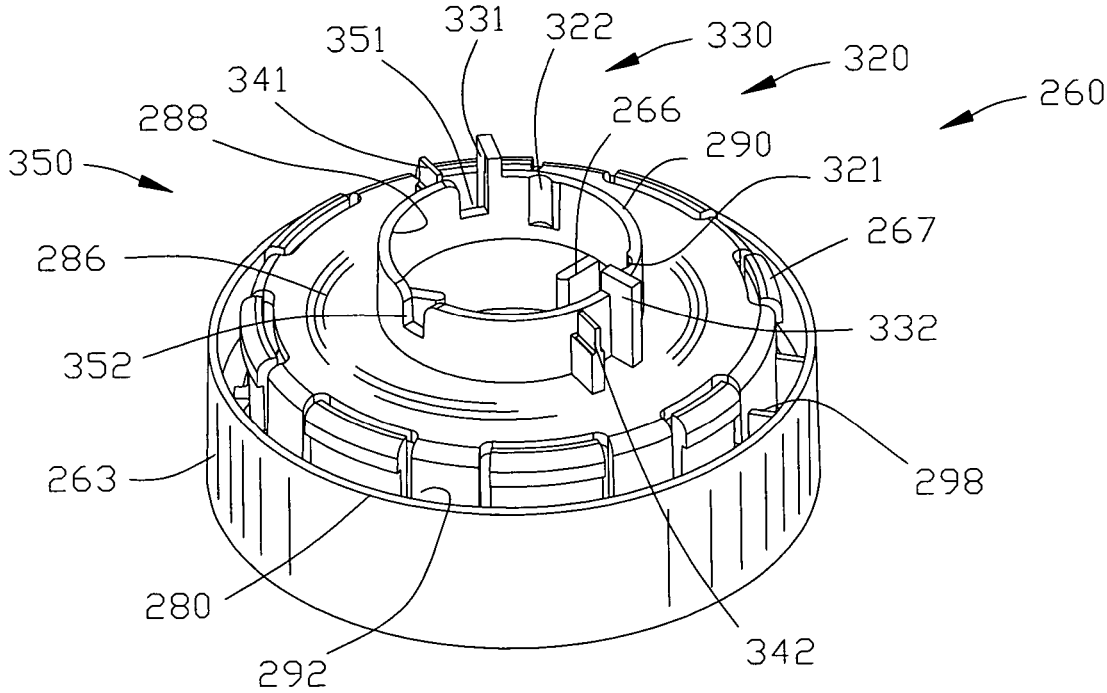
FIG. 37 is a top isometric view of a base portion of the improved actuator of FIGS. 31-36.
Figure 38:
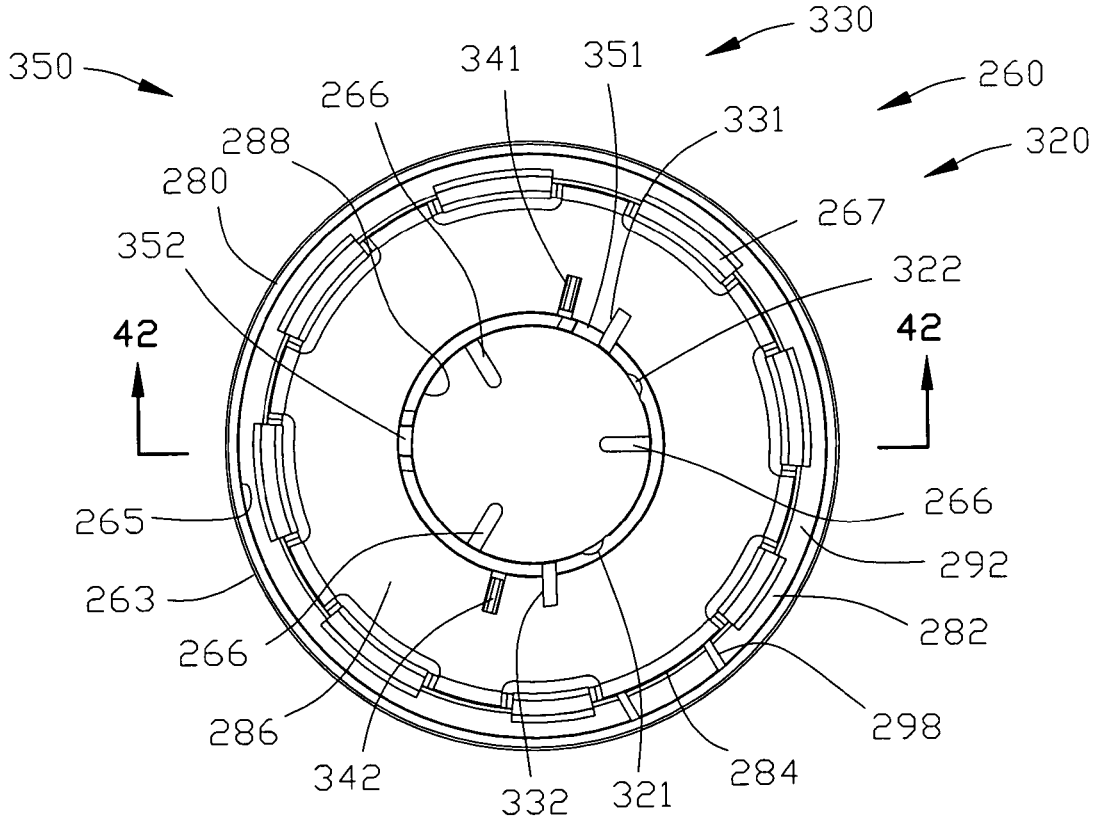
FIG. 38 is a top view of the base shown in of FIGS. 31-36.
Figure 39:
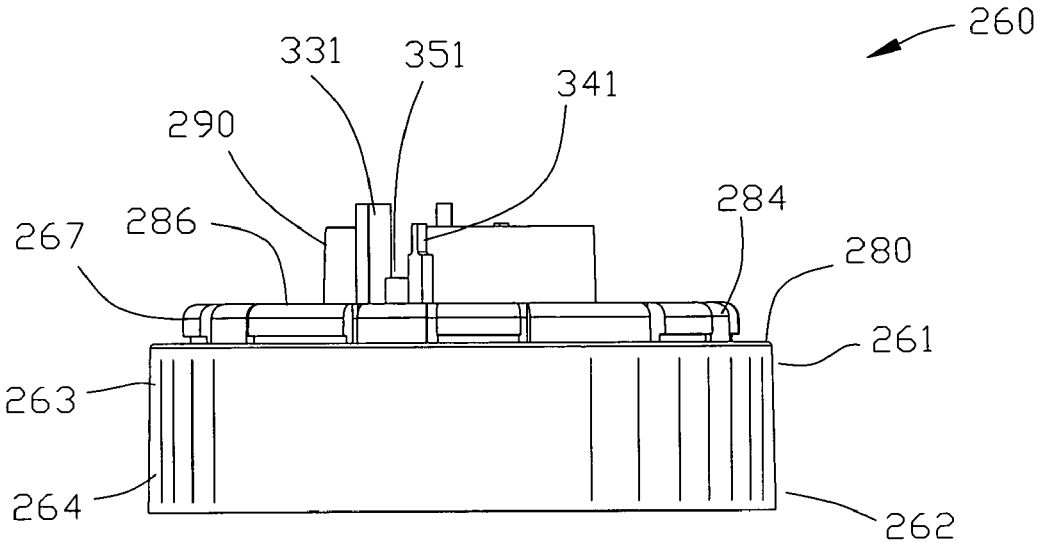
FIG. 39 is a left side view of the base of FIG. 37.
Figure 40:
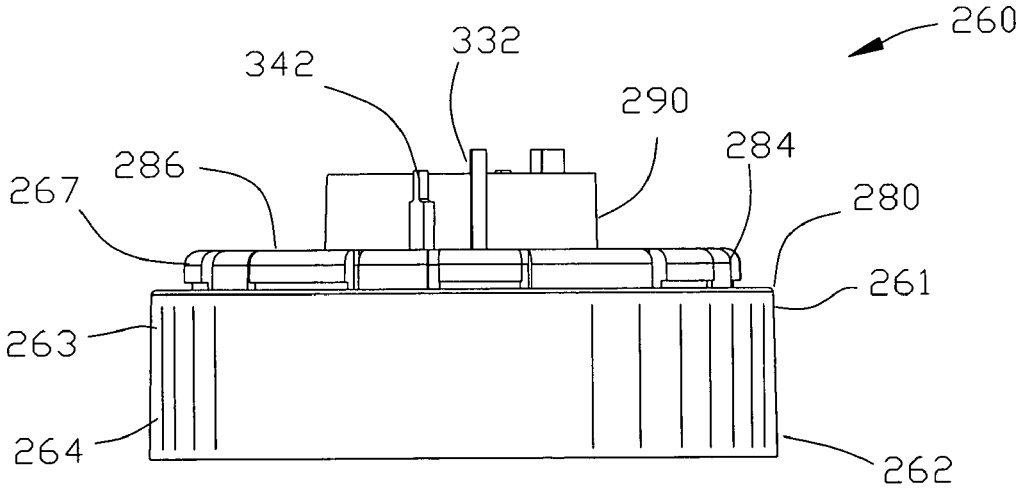
FIG. 40 is a right side view of the base of FIG. 37.
Figure 41:
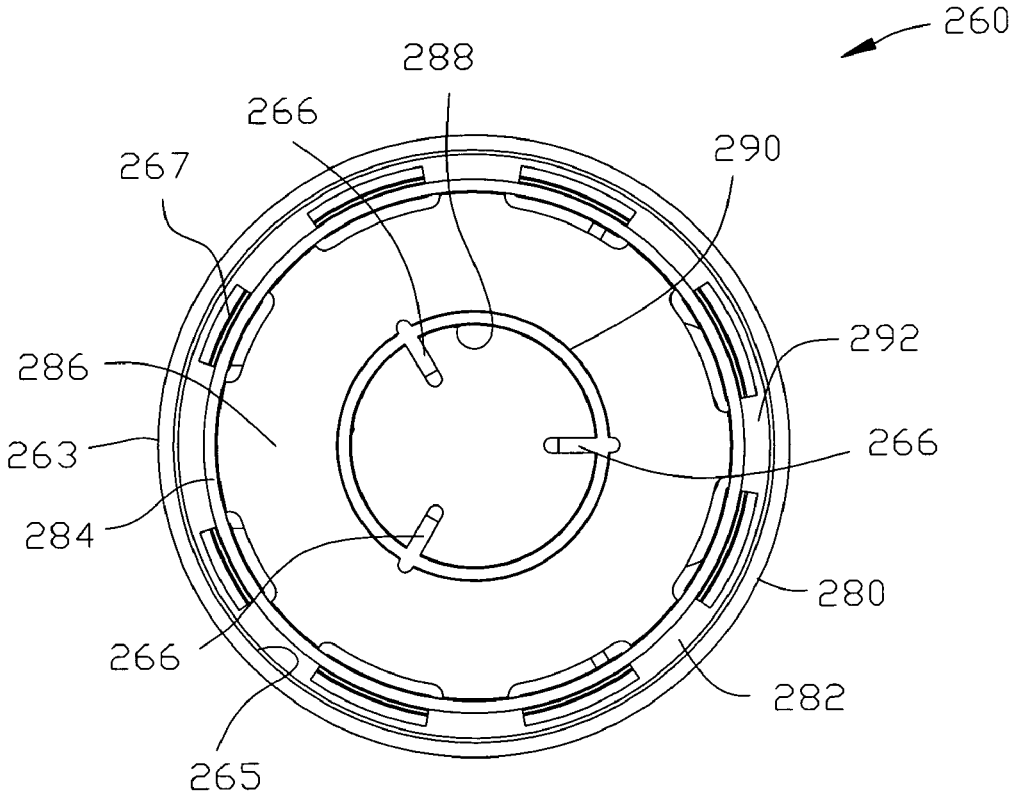
FIG. 41 is a bottom view of FIG. 38.
Figure 42:
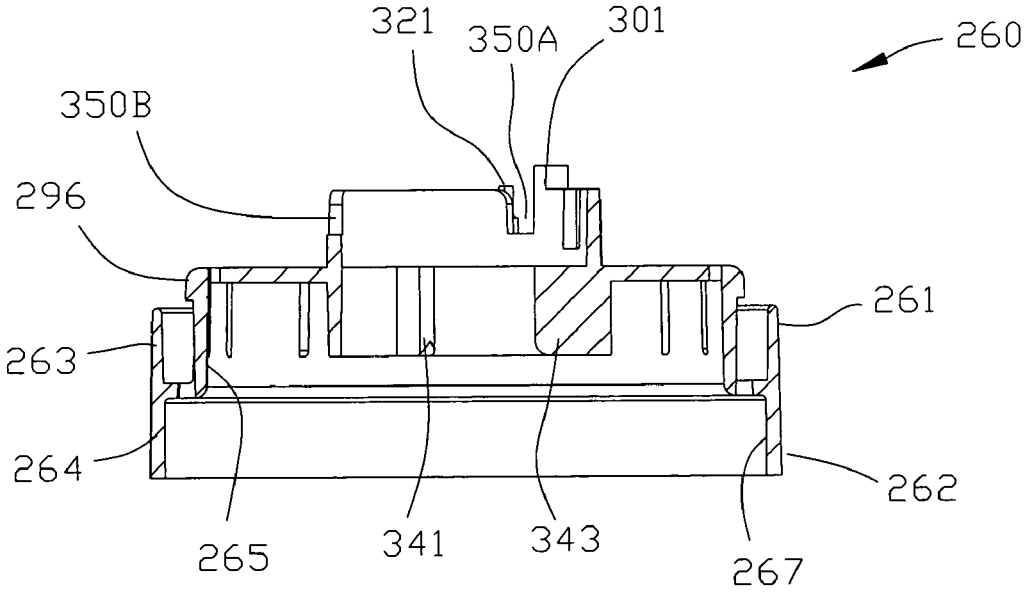
FIG. 42 is a sectional view along line 42-42 in FIG. 38.
Figure 43:
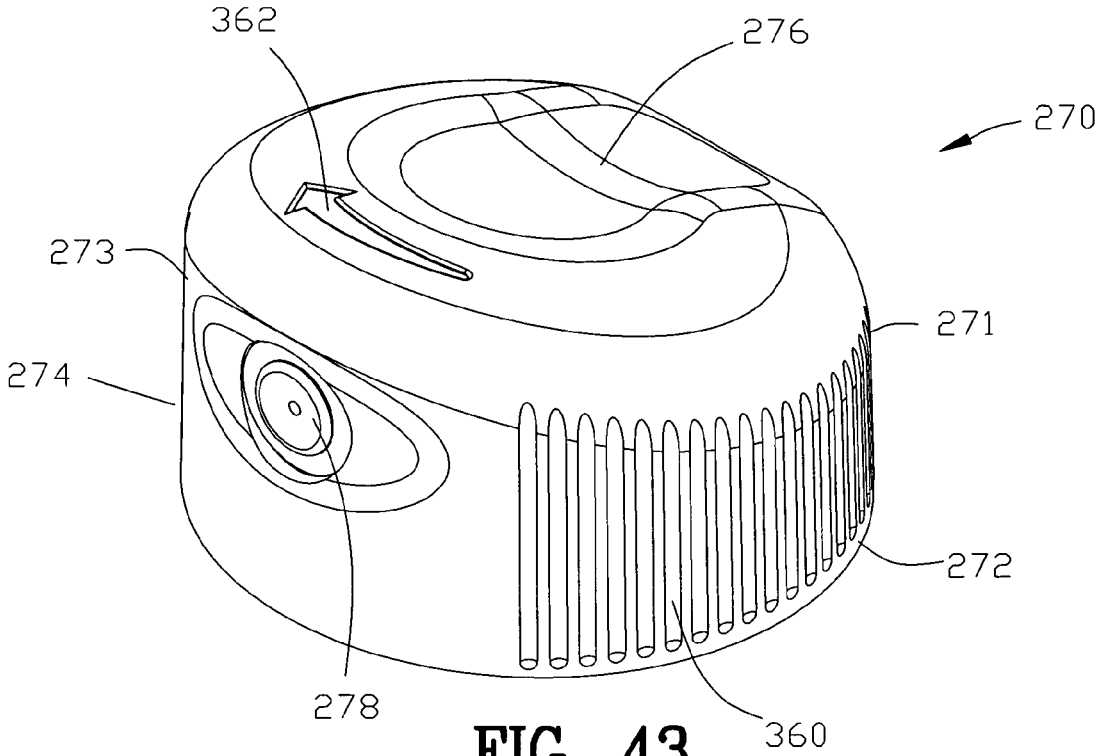
FIG. 43 is a top isometric view of the actuator button of FIGS. 31-36.
Figure 44:
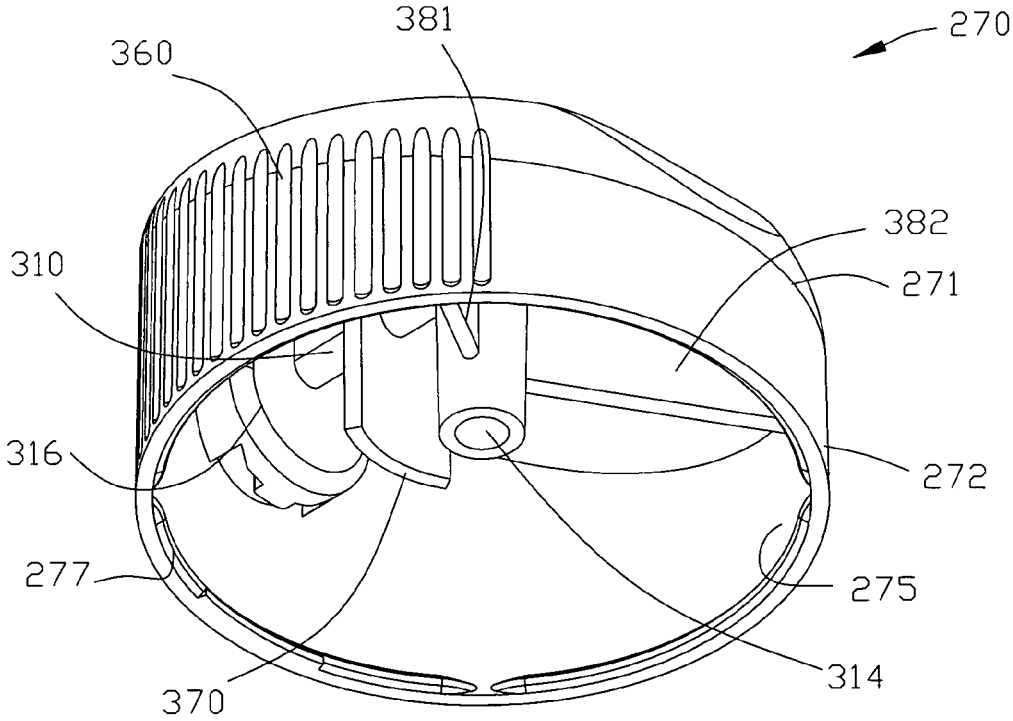
FIG. 44 is a bottom isometric view of the actuator button of FIGS. 31-36.
Figure 45:
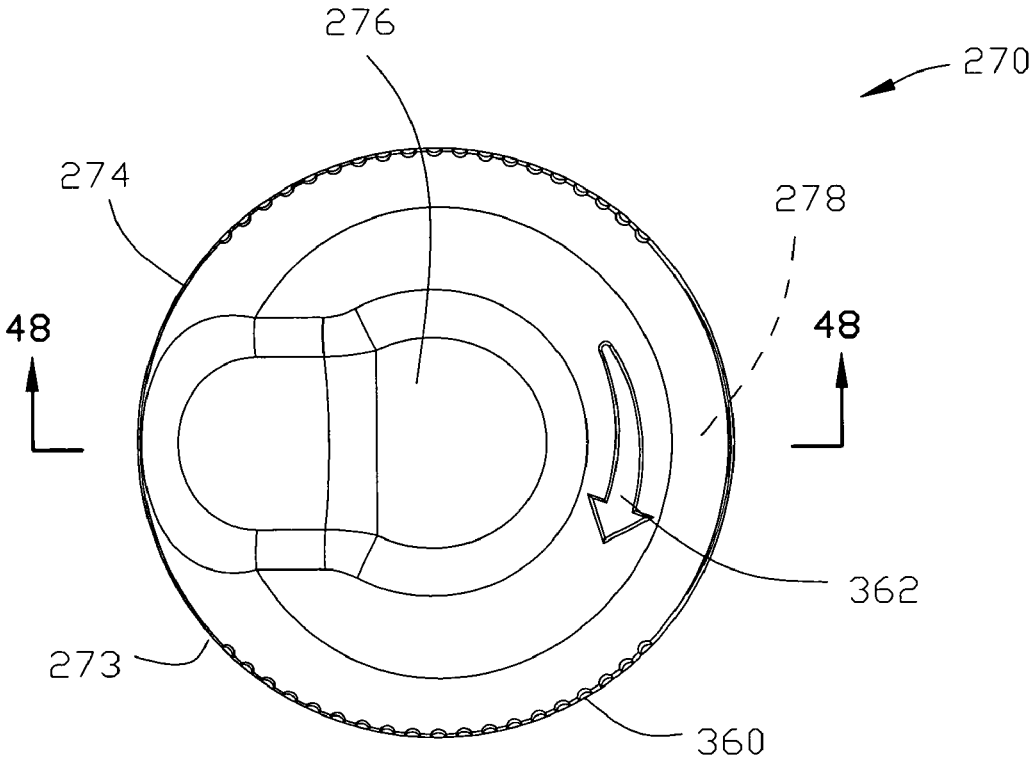
FIG. 45 is a top view of the actuator button of FIGS. 43-44.
Figure 46:
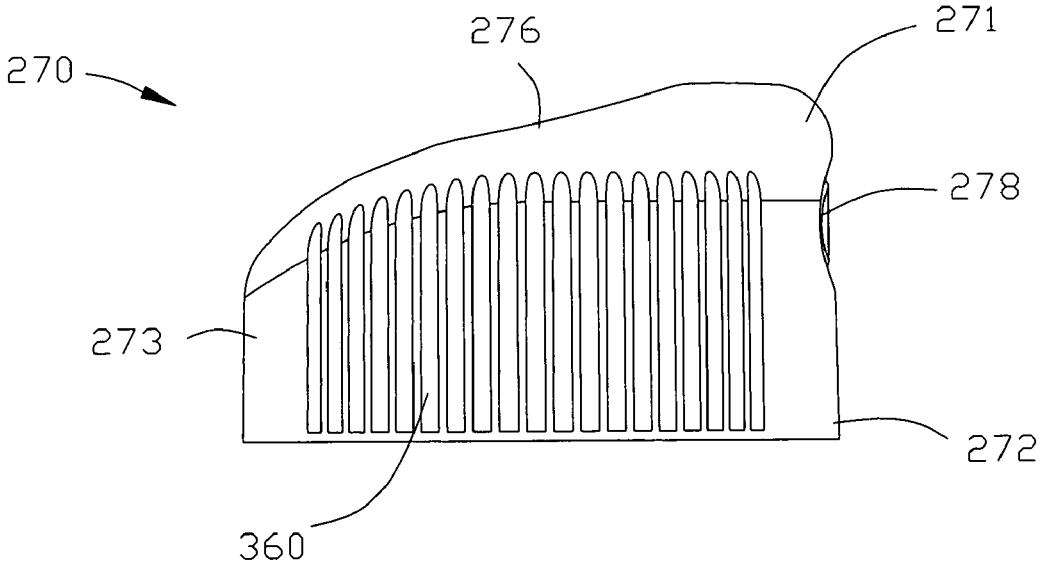
FIG. 46 is a side view of the actuator button of FIG. 45.
Figure 47:
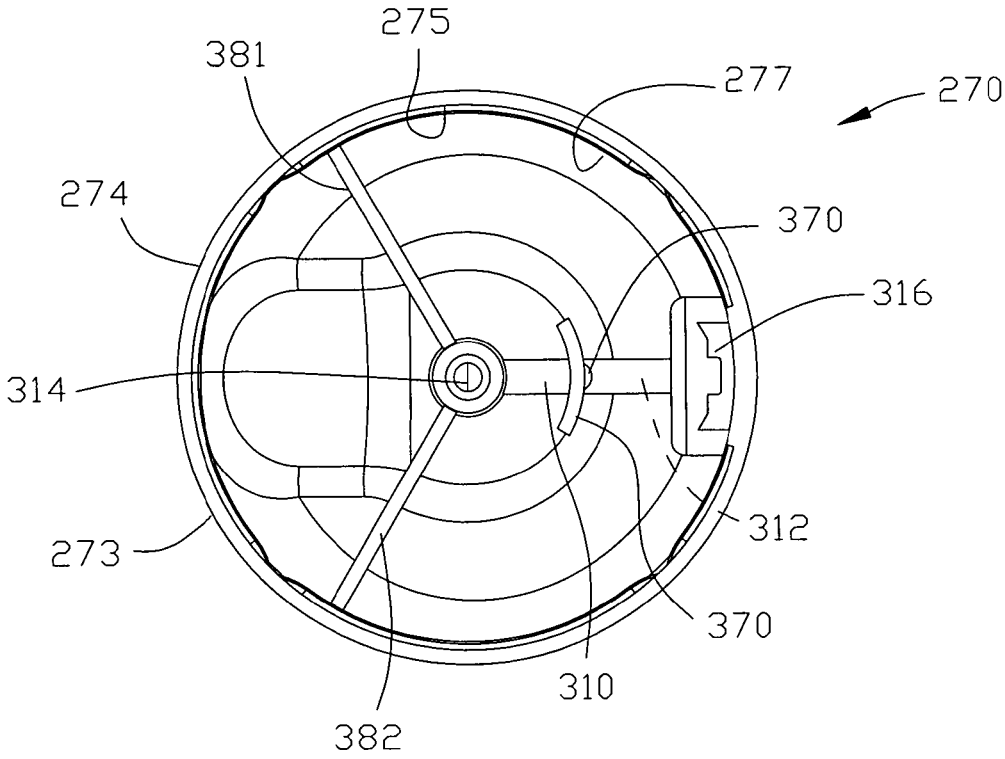
FIG. 47 is a bottom view of FIG. 46.
Figure 48:
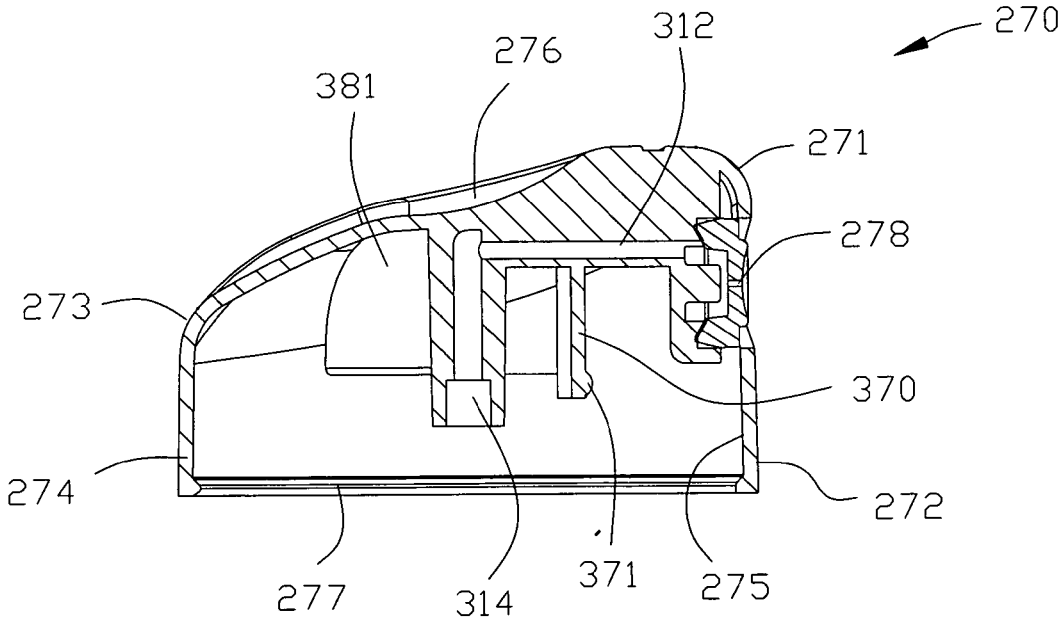
FIG. 48 is a sectional view along line 48-48 in FIG. 45.

FIGS. 31 and 32 illustrate a second embodiment of the improved actuator 210 of the present invention for dispensing an aerosol product 211 with an aerosol propellant 212. The second embodiment of the improved actuator 210 defines an axis of symmetry 213. An aerosol valve 220 having a valve stem 230 controls the flow of the aerosol product 211 from an aerosol container 240.

The aerosol container 240 is shown as a cylindrical container of conventional design and material. The aerosol container 240 is commonly referred to as a 202 can. Although the aerosol container 240 has been shown as a 202 can of conventional design, it should be understood that the improved actuator 210 of the present invention may be used with aerosol containers of various designs.

The aerosol container 240 extends between a top portion 241 and a bottom portion 242 with a cylindrical sidewall 243 located therebetween. The bottom portion 242 of the aerosol container 240 is closed by an endwall 244. A chine 245 is secured to the top portion 241 of the aerosol container 240 by an annular seam 248 for closing the top portion 241 of the aerosol container 240. The chine 245 terminates in a bead 246 defining an opening 247 in the aerosol container 240 for receiving a mounting cup 250.

The mounting cup 250 includes a peripheral rim 252 for sealing to the bead 246 of the aerosol container 240 and includes a turret 254 for receiving the aerosol valve 220. The aerosol valve 220 includes a valve body 222 secured to the turret 254 of the mounting cup 250. The valve body 222 defines an internal valve cavity 224 in fluid communication with the aerosol container 240 through a dip tube 226. The aerosol valve 220 includes a valve element 228 positioned within the internal valve cavity 224. A bias spring 229 biases the valve element 228 into a closed position to inhibit the flow of the aerosol product 211 through the valve stem 230.

The valve stem 230 extends between a first end 231 and a second end 232 and defines an outer surface 233 with a stem passageway 234 extending therein. The stem passageway 234 provides fluid communication to the second end 232 of the valve stem 230 from the aerosol valve 220. A depression of the valve stem 230 moves the valve element 228 into an open position against the urging of the bias spring 229 to permit the flow of the aerosol product 211 from the second end 232 of the valve stem 230.

Figure 49:
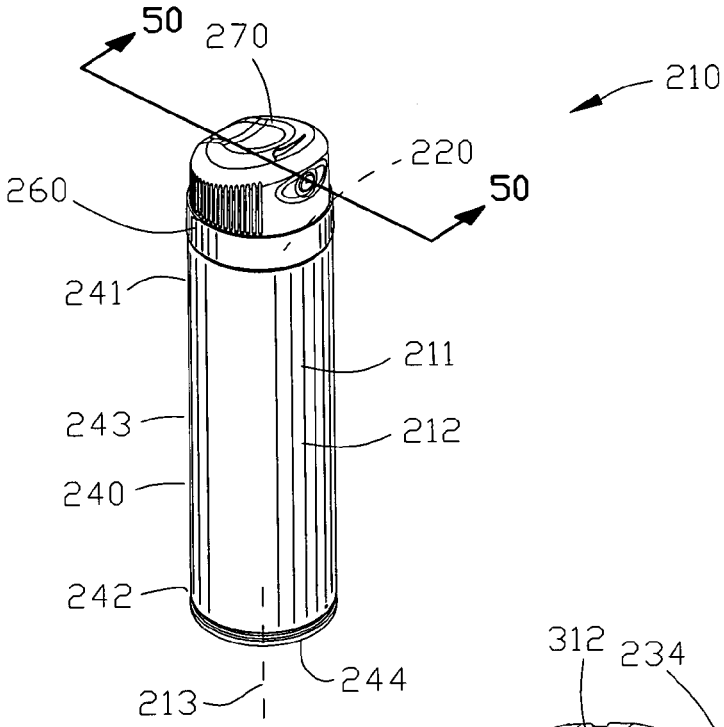
FIG. 49 is a top isometric view similar to FIG. 31 with the actuator button being located in a locked rotational position.
Figure 50:
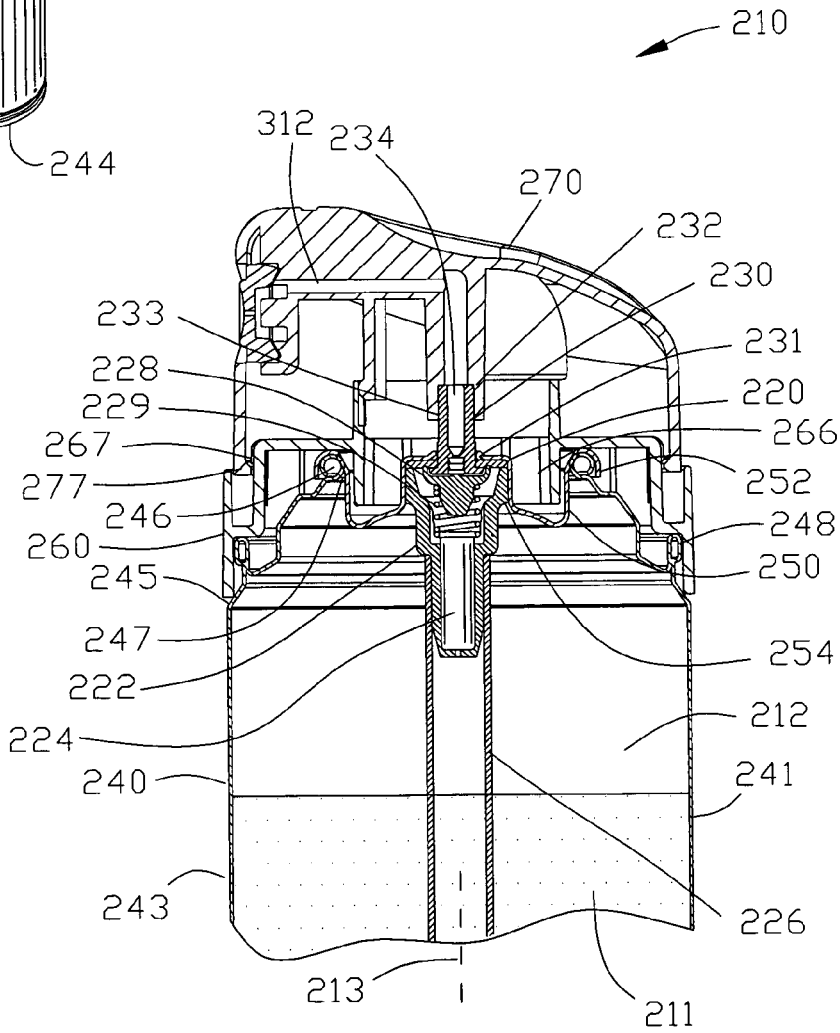
FIG. 50 is an enlarged partial sectional view along line 50-50 in FIG. 49.
Figure 51:
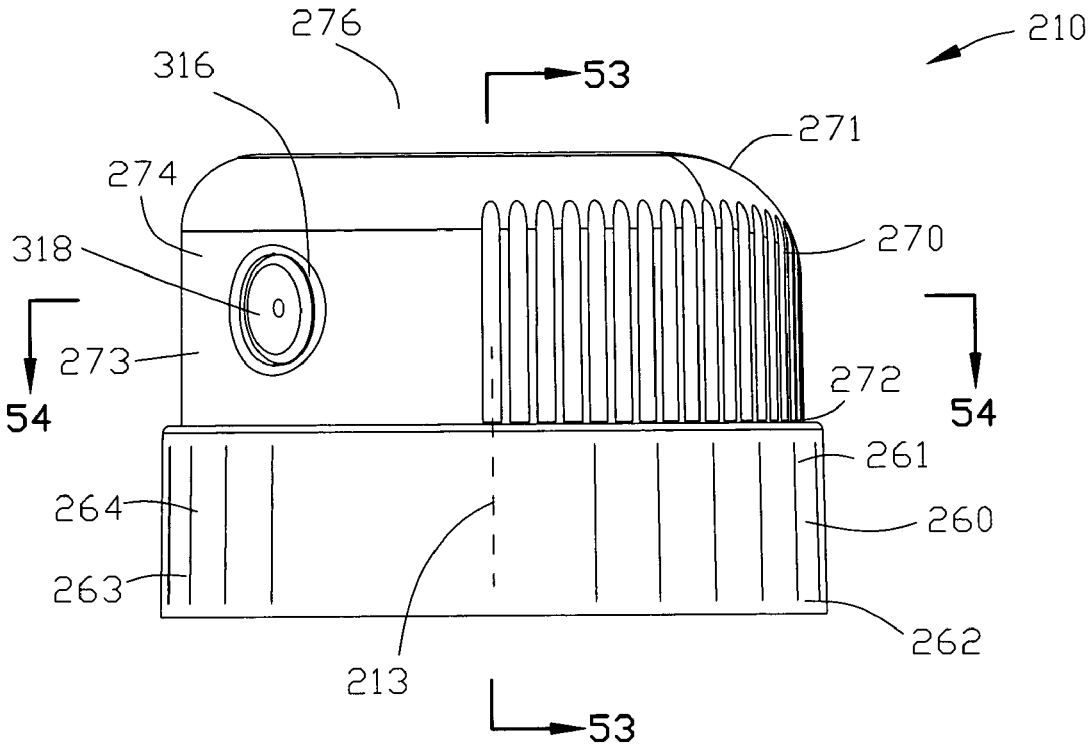
FIG. 51 is an enlarged front view of the improved actuator of FIG. 50.
Figure 52:
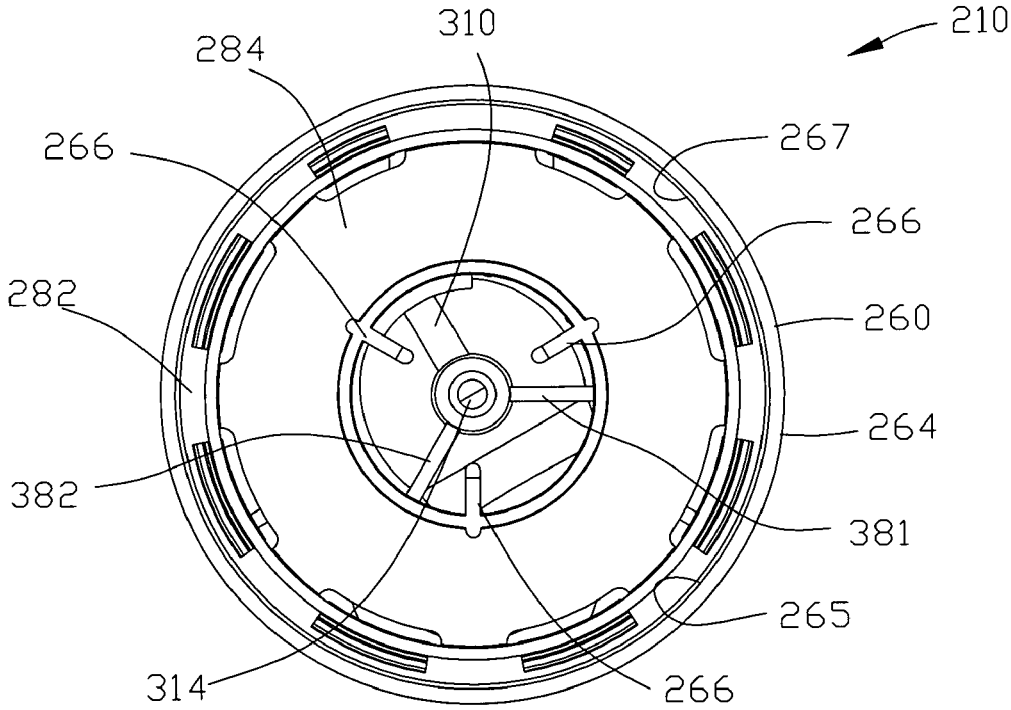
FIG. 52 is a bottom view of FIG. 51.
Figure 53:
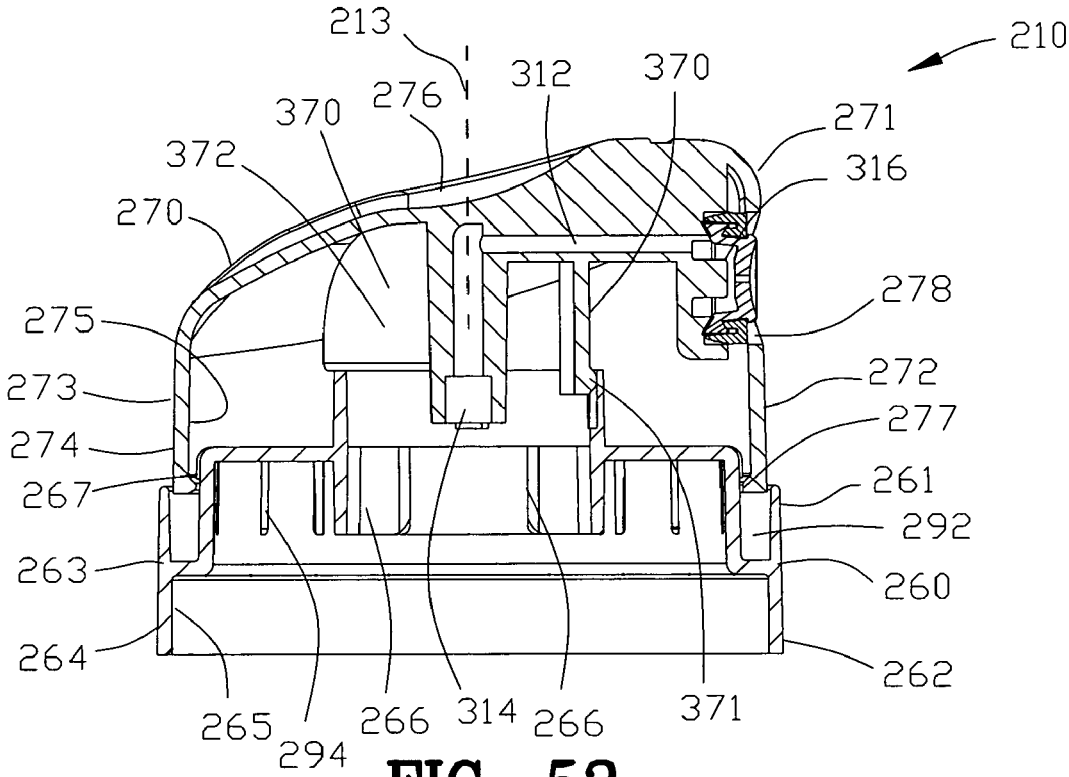
FIG. 53 is a sectional view along line 53-53 in FIG. 51.

FIGS. 33-36 are enlarged views of the second embodiment of the improved actuator 210 of FIGS. 31 and 32. The improved actuator 210 comprises a base 260 and an actuator button 270. The actuator button 270 is rotatable relative to the base 260 between an unlocked rotational position as shown in FIGS. 31 and 32 and a locked rotational position as shown in FIGS. 49 and 50. In the first embodiment of the improved actuator 10 of FIGS. 1-30, the actuator button 70 is rotated in a clockwise direction from the unlocked rotational position to the locked rotational position. In contrast, the actuator button 270 is rotated in a counterclockwise direction from the unlocked rotational position to the locked rotational position in the second embodiment of the improved actuator 210 of FIGS. 31-60.

Figure 55:
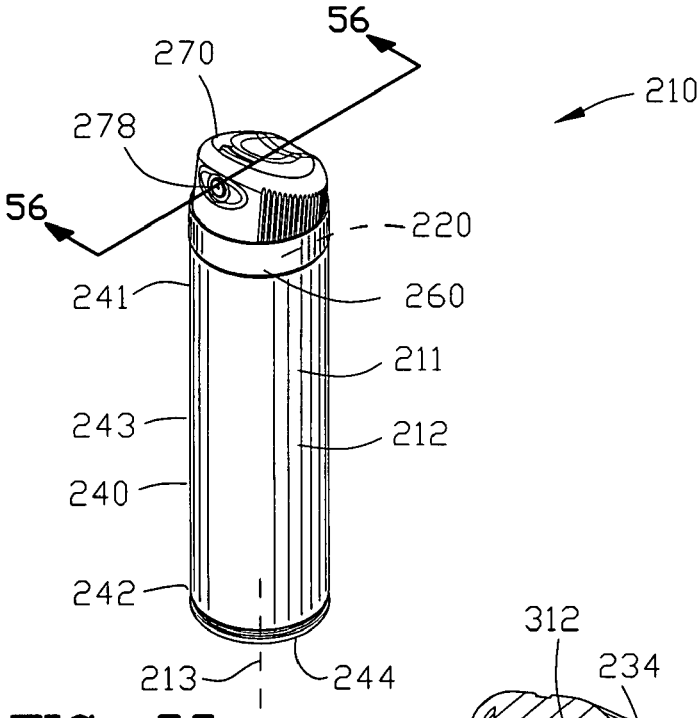
FIG. 55 is a top isometric view similar to FIG. 31 with the actuator button being located in an unlocked rotational position and in an actuated position.
Figure 56:
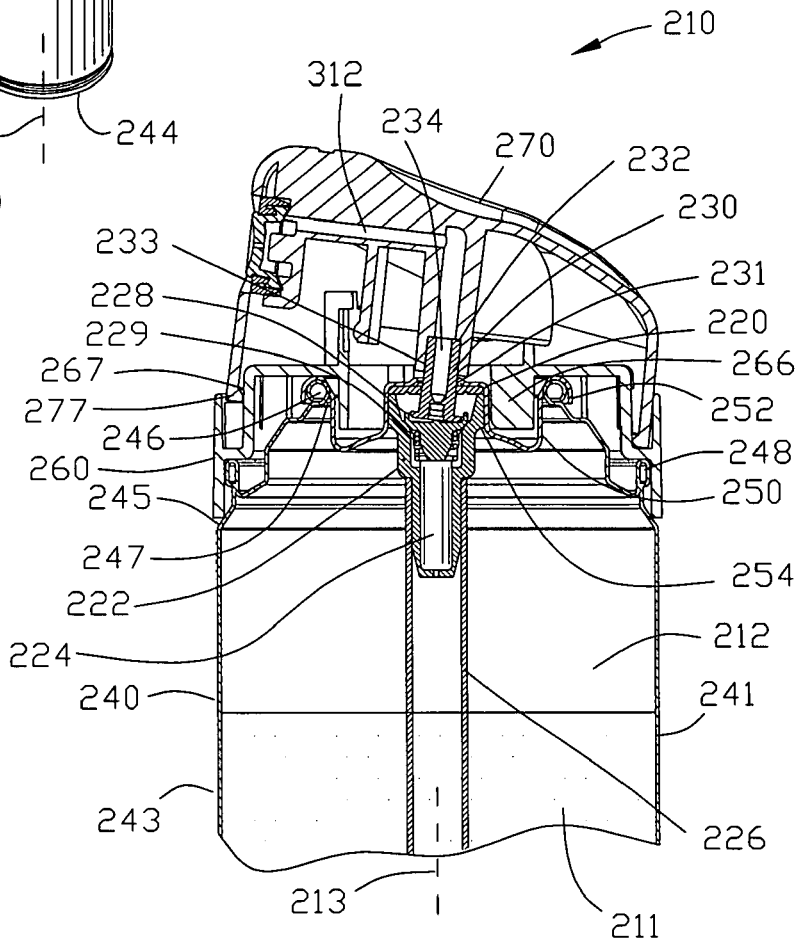
FIG. 56 is an enlarged partial sectional view along line 56-56 in FIG. 55.
Figure 57:
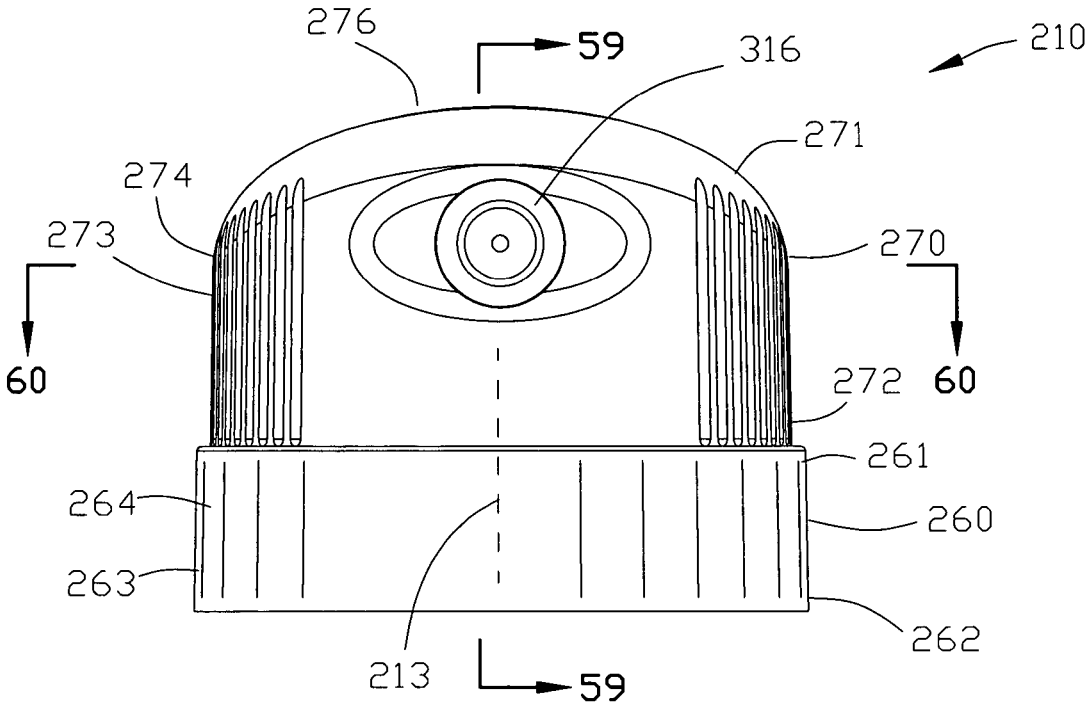
FIG. 57 is an enlarged front view of the improved actuator of FIG. 55.
Figure 58:
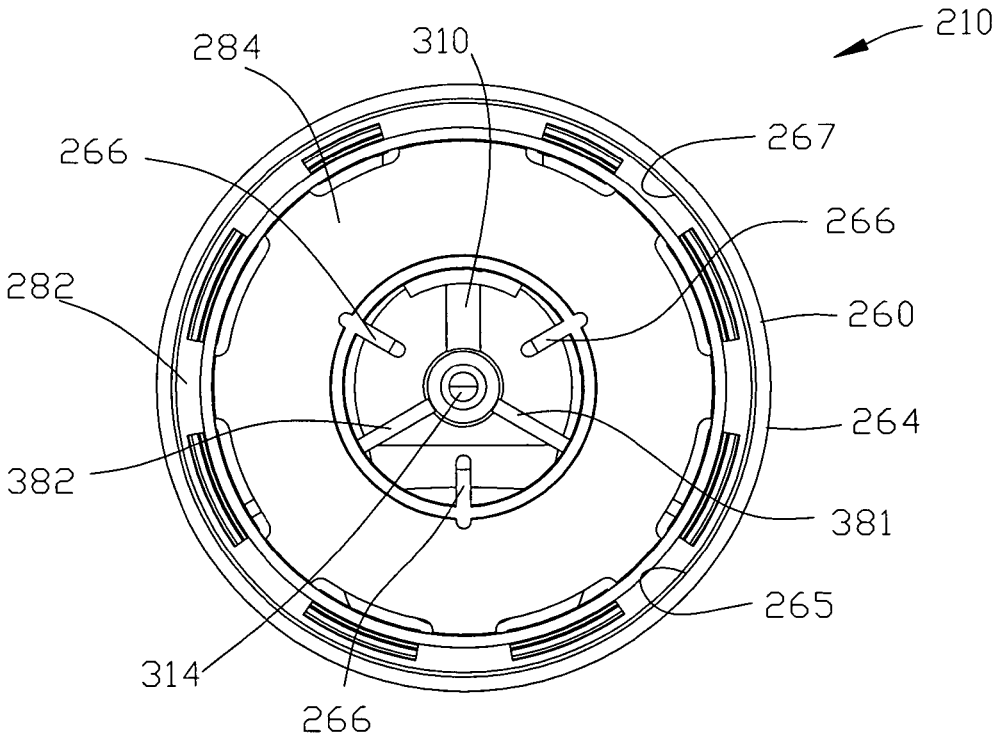
FIG. 58 is a bottom view of FIG. 57.
Figure 59:
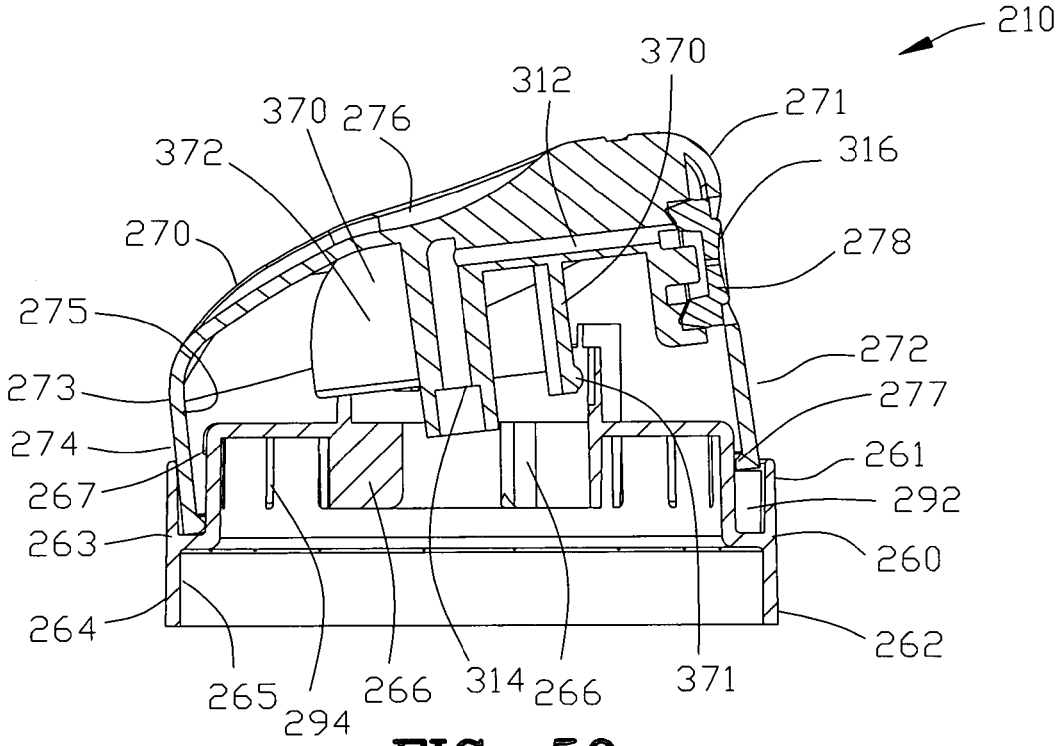
FIG. 59 is a sectional view along line 59-59 in FIG. 57.

The actuator button 270 is tiltable relative to the base 260 as shown in FIGS. 55 and 56 for actuating the aerosol valve 220 to dispense the aerosol product 211 from the aerosol container 240 when the actuator button 270 is rotated into the unlocked rotational position as shown in FIGS. 31 and 32. The actuator button 270 is inhibited from tilting relative to the base 260 when the actuator button 270 is moved into the locked rotational position as shown in FIGS. 49 and 50.

The base 260 extends between a top portion 261 and a bottom portion 262 with a cylindrical sidewall 263 located therebetween. The sidewall 263 of the base 260 defines an outer surface 264 and an inner surface 265 coaxial with the axis of symmetry 213 of the actuator 210. The bottom portion 262 of the base 260 covers the annular seam 248 located at the top portion 241 of the aerosol container 240.

The base 260 includes a base mounting 266 for securing the base 260 to the aerosol container 240. The base mounting 266 is shown as a plurality of radial base projections 266 extending radially inwardly for securing the base 260 to the aerosol container 240. In this example, the plurality of radial base projections 266 engage with the turret 254 of the mounting cup 250 in a frictional engagement. However, it should be understood that the base projection 266 may engage the annular seam 248 located at the top portion 241 of the aerosol container 240 in a snap locking engagement.

The base 260 includes a base retainer 267 for rotationally securing the actuator button 270 to the base 260. The base retainer 267 comprises a plurality of annular projections 267 extending radially outwardly from the base 260. The plurality of annular projections 267 are distributed about the axis of symmetry 213 of the aerosol actuator 210.

The actuator button 270 is shown as unitary actuator button 270 extending between a top portion 271 and a bottom portion 272 with a cylindrical sidewall 273 located therebetween. The sidewall 273 of the actuator button 270 is a substantially rigid sidewall 273 defining an outer surface 274 and an inner surface 275 coaxial with the axis of symmetry 213 of the actuator 210. The substantially rigid sidewall 273 of the actuator button 270 supports a rigid top actuating surface 276.

The actuator button 270 includes a button retainer 277 for cooperating with the base retainer 267 for rotationally securing the actuator button 270 to the base 260. The button retainer 277 is shown as a plurality of annular projections 277 extending radially inwardly from the inner surface 275 of the sidewall 273 of the actuator button 270. The radially inwardly extending button retainers 277 cooperate with the radially outwardly extending button retainers 267 for rotationally securing the actuator button 270 to the base 260.

FIGS. 37-42 illustrate various views of the base 260 shown in FIGS. 33-36. The first end 261 of the base 260 defines an outer ring 280. The outer ring 280 is a substantially cylindrical upper portion of the cylindrical sidewall 263. A plurality of radial ribs 282 extends radially inwardly from the inner surface 265 of the cylindrical sidewall 263. The plurality of radial ribs 282 supports an inner ring 284. The outer ring 280 and the inner ring 284 are coaxial with the axis of symmetry 213 of the actuator 210.

An inner base platform 286 extends radially inwardly from the inner ring 284 and defines a central platform aperture 288. The inner base platform 286 supports a central ring 290 located within the central platform aperture 288. The central ring 290 is coaxial with the outer ring 280 and the inner ring 284. The central ring 290 extends upwardly from the inner base platform 286 of the base 260. Preferably, the central ring 290 is integrally formed with the inner base platform 286 of the base 260. The plurality of radial base projections 266 provides additional support to the central ring 290 from the inner base platform 286.

The inner ring 284 includes the base retainer 267 for cooperating with the button retainer 277 for rotationally securing the actuator button 270 to the base 260. The base retainer 267 is shown as a generally annular projection 267 extending radially outwardly from the inner ring 284 of the base 260. Preferably, the inner ring 284 of the base 260 is deformable for enabling the button retainer 277 to pass over the base retainer 267. After the button retainer 277 passes over the base retainer 267, the base retainer 267 engages with the button retainer 277 to retain the actuator button 270 on the base 260. The button retainer 277 of the actuator button 270 interlocks with the base retainer 267 for rotationally securing the actuator button 270 to the base 260.

A void 292 is defined between the outer ring 280 and the inner ring 284 of the base 260. A bridge 298 extends across the void 292 between the outer ring 280 and the inner ring 284 of the base 260. The bridge 298 extends across a first portion of the inner ring 284 in proximity to the level of the first end 261 of the base 260. The bridge 298 occupies a minor portion of the circumference of the inner ring 284. In this example, the bridge 298 occupies a five to ten degree arc portion of the circumference of the inner ring 284 about the axis of symmetry 213 of the actuator 210.

The base 260 includes a locator recess 320 defined in the central ring 290 for cooperating with the actuator button 270 for defining an unlocked position and a locked rotational position of the actuator button 270 relative to the base 260. More specifically, the locator recess 320 includes an unlocked locator recess 321 for establishing the unlocked rotational position of the actuator button relative to the base 260 as shown in FIGS. 31 and 32. The locator recess 320 includes a locked locator recess 322 for establishing the locked rotational position of the actuator button relative to the base 260 as shown in FIGS. 49 and 50.

The base 260 includes a base stop 330 for cooperating with the actuator button 270 for establishing an unlocked position and a locked rotational position of the actuator button 270 relative to the base 260. More specifically, the base stop 330 includes an unlocked position stop 331 for establishing the unlocked rotational position of the actuator button relative to the base 260 as shown in FIGS. 31 and 32. The base stop 330 includes a locked position stop 332 for establishing the locked rotational position of the actuator button relative to the base 260 as shown in FIGS. 49 and 50.

The base 260 includes audible ribs 340 for cooperating with the actuator button 270 for audibly indicating the unlocked rotational position and the locked rotational position of the actuator button 270 relative to the base 260. More specifically, the audible ribs 340 includes an unlocked audible rib 341 for audibly indicating the unlocked rotational position of the actuator button 270 relative to the base 260 as shown in FIGS. 31 and 32. The audible ribs 340 includes a locked audible rib 342 for audibly indicating the locked rotational position of the actuator button 270 relative to the base 260 as shown in FIGS. 49 and 50.

The base 260 includes a groove 350 is defined in the central ring 290 of the base 260 for enabling the actuator button 270 to the tilted relative to the base 260 as shown in FIGS. 55 and 56. More specifically, the groove 350 includes plural grooves 351 and 352 formed within the central ring 290 of the base 260

FIGS. 43-48 illustrate various views of the actuator button 270 shown in FIGS. 31-36. In this embodiment of the invention, a nozzle 310 is integrally formed with the actuator button 270. Preferably, the nozzle 310 is molded into the actuator button 270 as a one piece unit. The nozzle 310 defines a nozzle channel 312 extending between a socket 314 and a terminal orifice 316. The socket 314 is adapted to frictionally receive the second end 232 of the valve stem 230. The terminal orifice 316 is defined in the sidewall 273 of the actuator button 270. The terminal orifice 316 may optionally receive a terminal orifice insert 318 for controlling the spray patter and/or the spray characteristics of the aerosol product 211 being discharged from the actuator 210.

A depression of the actuator button 270 as shown in FIGS. 55 and 56 pivots the nozzle 310 about the bridge 298 to depress the valve stem 230. The depression of the valve stem 230 moves the valve element 228 into an open position to permit the flow of the aerosol product 211 through the stem passage 234 of the valve stem 230 and thorough the nozzle channel 312 of the nozzle 310 for discharge from the terminal orifice 316.

Preferably, the cylindrical sidewall 273 includes knurls 360 for assisting in the rotation of the actuator button 270 relative to the base 260. The top actuating surface 276 of the actuator button 270 may include a rotation indicator 362 for indicating the direction of rotation of the actuator button 270 relative to the base 260 between the unlocked rotational position and the locked rotational position.

The actuator button 270 includes a depending wall 370 integrally formed with the inner surface 275 of the top actuating surface 276 of the actuator button 270. In this example, the depending wall 370 is shown as a partially cylindrical wall having a radius for cooperation with the central platform aperture 288. A locator projection 371 extends from the depending wall 370 for engagement with the unlocked locator recess 321 and the locked locator recess 322.

The actuator button 270 includes a groove rib 380 extending from the inner surface 275 and the rigid top actuating surface 276 of the actuator button 270. Preferably, the groove rib 380 is formed as a one-piece unit of the actuator button 270. More specifically, the groove rib 380 includes plural grooves 381 and 382 equally spaced with the nozzle 310 about the axis of symmetry 213 of the aerosol actuator 210.

The plural groove ribs 381 and 382 are aligned with the plural grooves 351 and 352 formed within the central ring 290 of the base 260 when the actuator button 270 is established in the unlocked rotational position as shown in FIGS. 31 and 32. Only the groove rib 381 is aligned with the groove 351 when the actuator button 270 is established in the locked rotational position as shown in FIGS. 49 and 50. The groove rib 382 is not aligned with either of the plural grooves 351 and 352 formed within the central ring 290 of the base 260 when the actuator button 270 is established in the locked rotational position as shown in FIGS. 49 and 50.

As will be described hereinafter, the plural groove ribs 381 and 382 interact with the base stop 330 for establishing an unlocked position and a locked rotational position of the actuator button 270 relative to the base 260. The plural groove ribs 381 and 382 also interact with the audible ribs 340 for audibly indicating the unlocked rotational position and the locked rotational position of the actuator button 270 relative to the base 260.

Figure 54:
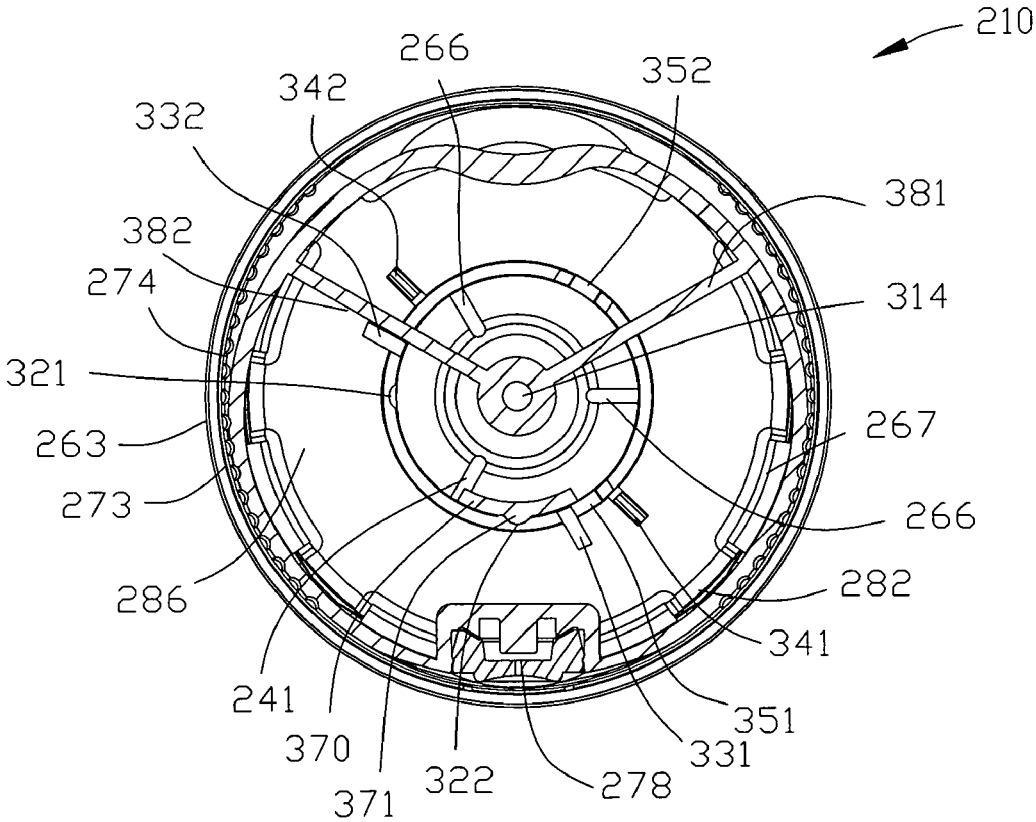
FIG. 54 is a sectional view along line 54-54 in FIG. 51.

FIGS. 49-54 are various views of the improved actuator 210 of FIGS. 31 and 32 with the actuator button 270 being located in the locked rotational position. The actuator button 270 has been rotated counterclockwise relative to the base 260 with the locator projection 371 moving from the unlocked locator recess 321 to the locked locator recess 322. Concomitantly therewith, the actuator button 270 has been rotated counterclockwise relative to the base 260 until the groove rib 382 of the actuator button 270 engages the locked position stop 332 of the base 260. During the counterclockwise rotation of the actuator button 270 from the unlocked rotational position to the locked rotational position, the groove ribs 381 and 382 of the actuator button 270 pass over the unlocked and locked audible ribs 341 and 342, respectively, to provide and two independent audible clicks. The groove rib 382 of the actuator button 270 is maintained in the locked rotational position between the locked position stop 332 and the locked audible ribs 342 as shown in FIG. 54.

When the actuator button 270 is located in the locked rotational position, the groove rib 381 engages with the central ring 290 of the base 260 to prevent the actuator button 270 from tilting relative to the base 260. When the actuator button 270 is moved into the locked rotational position, the nozzle 310 is inhibited from actuating the aerosol valve 220.

FIGS. 55-60 are various views of the improved actuator 210 of FIGS. 31 and 32 with the actuator button 270 being located in the unlocked rotational position and with the actuator button 270 being in an actuated position. The actuator button 270 has been rotated clockwise relative to the base 260 with the locator projection 371 moving from the locked locator recess 322 to the unlocked locator recess 321. Concomitantly therewith, the actuator button 270 has been rotated clockwise relative to the base 260 until the groove rib 381 of the actuator button 270 engages the unlocked position stop 331 of the base 260. During the clockwise rotation of the actuator button 270 from the locked rotational position to the unlocked rotational position, the groove ribs 381 and 382 of the actuator button 270 passes over the unlocked and locked audible ribs 341 and 342, respectively, to provide and two independent audible clicks. The groove rib 381 of the actuator button 270 is maintained in the unlocked rotational position between the locked position stop 331 and the locked audible ribs 341.

Figure 60:
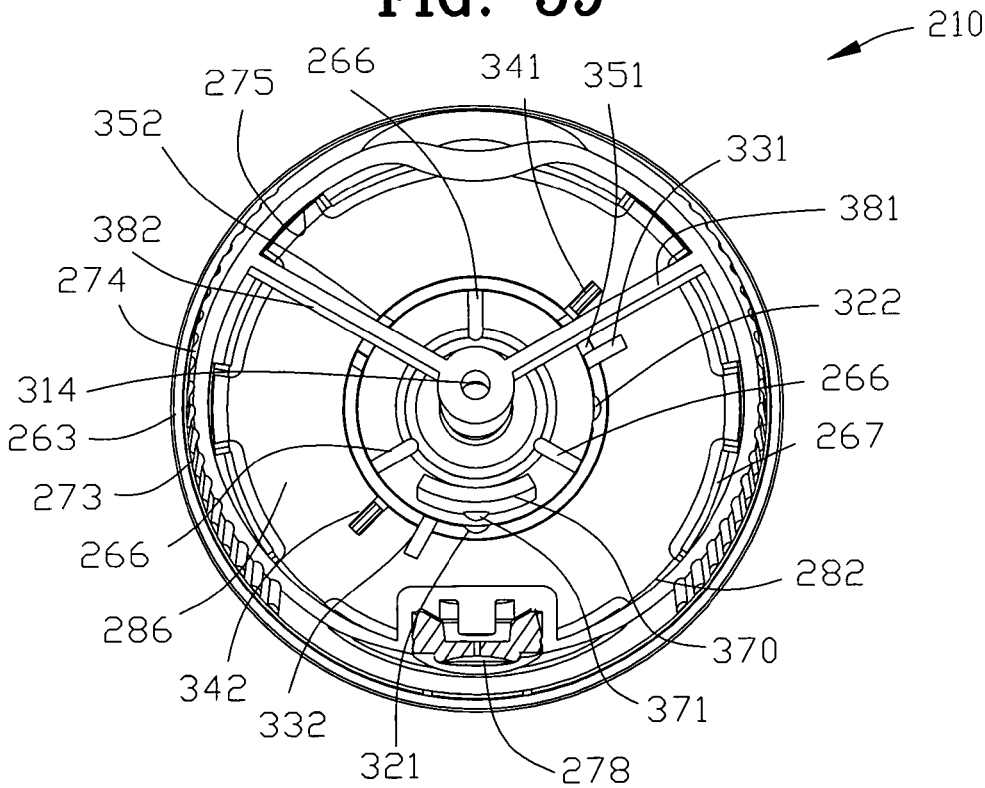
FIG. 60 is a sectional view along line 60-60 in FIG. 57.

In the unlocked rotational position, the plural groove ribs 381 and 382 are aligned with the plural grooves 351 and 352 formed within the central ring 290 of the base 260 when the actuator button 270 is established in the unlocked rotational position as shown in FIG. 60.

A depression of the top actuating surface 276 by an operator causes the total actuator button 270 to tilt about the bridge 298 extending across a first portion of the inner ring 284. The actuator button 270 tilts in its entirety as a unit relative to the base 260 as the plural groove ribs 381 and 382 enter the plural grooves 351 and 352 defined in the central 290 of the base 260. A portion of the sidewall 273 of the actuator button 270 enters the void 292 between the outer ring 280 and the inner ring 284.

The tilting of the actuator button 270 tilts the integral nozzle 310 to actuate the aerosol valve 220. The actuator button 270 is tiltable relative to the base 260 for actuating the aerosol valve 220 to dispense the aerosol product 211 from the aerosol container 240 for discharge through the terminal orifice 316 when the actuator button 270 is rotated into the unlocked rotational position.

The present invention provides an improved actuator having an actuator button being rotatable between an unlocked and a locked rotational position for permitting and inhibiting the dispensing of an aerosol product therefrom. The improved actuator has an actuator button that is tiltable for dispensing the aerosol product when the actuator button is rotated into the unlocked rotational position and for inhibiting the tilting of the actuator button when the actuator button is moved into the locked rotational position. The actuator button is tiltable essentially in its entirety as a rigid unitary unit when the actuator button is moved into the unlocked rotational position upon depression of the top actuating surface.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved actuator for actuating an aerosol valve for dispensing an aerosol product from an aerosol container, comprising:

a base having an axis of symmetry of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with an actuator button orifice defined in said sidewall of said actuator button;

said actuator button being rotatably mounted to said base to cover said nozzle;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable relative to said base for engaging and pivoting said nozzle button to actuate the aerosol valve for dispensing aerosol product from said terminal orifice and through said actuator button orifice defined in said sidewall of said actuator button when said actuator button is in said unlocked rotational position; and said unitary actuator button being inhibited from pivoting said nozzle button when said actuator button is rotated into said locked rotational position.

2. An improved actuator for actuating an aerosol valve for dispensing an aerosol product from an aerosol container, comprising:

a base having an axis of symmetry of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface formed from a unitary substantially rigid material for enabling the entirety of said actuator button to move as a unit relative to said base;

said unitary actuator button including said rigid sidewall and said rigid top actuating surface forming a continuous surface with an actuator button orifice defined in said sidewall of said actuator button;

said actuator button being rotatably mounted to said base to cover said nozzle;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable relative to said base for engaging and pivoting said nozzle button to actuate the aerosol valve for dispensing aerosol product from said terminal orifice and through said actuator button orifice defined in said sidewall of said actuator button when said actuator button is in said unlocked rotational position;

said unitary actuator button being inhibited from pivoting said nozzle button when said actuator button is rotated into said locked rotational position; and said rigid sidewall of said actuator button covering said terminal orifice of said nozzle when said actuator button is rotated into said locked rotational position.

3. An improved actuator for actuating an aerosol valve for dispensing an aerosol product from an aerosol container, comprising;

said base having an outer ring and an inner ring defined about an axis of symmetry of said base forming an annular void therebetween; and a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with an actuator button orifice defined in said sidewall of said actuator button;

said actuator button being rotatably mounted to said base to cover said nozzle;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable within said annular void between said outer ring and said inner ring of said base for engaging and pivoting said nozzle button to actuate the aerosol valve for dispensing aerosol product from said terminal orifice and through said actuator button orifice defined in said sidewall of said actuator button when said actuator button is in said unlocked rotational position; and said unitary actuator button being inhibited from pivoting said nozzle button when said actuator button is rotated into said locked rotational position.

4. An improved actuator for actuating an aerosol valve for dispensing an aerosol product from an aerosol container, comprising:

said base having an outer ring and an inner ring interconnected by a plurality of radial ribs defined about an axis of symmetry of said base forming an annular void therebetween;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with an actuator button orifice defined in said sidewall of said actuator button;

said actuator button being rotatably mounted to said base to cover said nozzle;

a portion of said rigid sidewall of said unitary actuator button extending into said annular void between said outer ring and said inner ring of said base;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable within said annular void between said outer ring and said inner ring of said base for engaging and pivoting said nozzle button to actuate the aerosol valve for dispensing aerosol product from said terminal orifice and through said actuator button orifice defined in said sidewall of said actuator button when said actuator button is in said unlocked rotational position; and said unitary actuator button being inhibited from pivoting said nozzle button when said actuator button is rotated into said locked rotational position.

5. An improved actuator for actuating an aerosol valve for dispensing an aerosol product from an aerosol container, comprising:

a base having an axis of symmetry of said base;

a bridge extending radially inwardly toward said axis of symmetry from a portion of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with a portion of said rigid sidewall being supported by said bridge;

said unitary actuator button being rotatable relative to said base for movement between a locked rotational position and an unlocked rotational position;

said unitary actuator button being tillable about said bridge of said base for actuating the aerosol valve to dispense the aerosol product from the aerosol container through said terminal orifice when said actuator button is rotated into said unlocked rotational position; and said unitary actuator button being inhibited from tilting about said bridge of said base when said actuator button is rotated into said locked rotational position.

6. An improved actuator for actuating an aerosol valve for dispensing an aerosol product from an aerosol container, comprising:

a base having an axis of symmetry of said base;

a bridge extending radially inwardly toward said axis of symmetry from a portion of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface being formed from a unitary substantially rigid material for enabling the entirety of said actuator button to move as a unit relative to said base;

a portion of said rigid sidewall being supported by said bridge;

said entirety of said unitary actuator button being rotatable relative to said base for movement between a locked rotational position and an unlocked rotational position;

said entirety of said unitary actuator button being tiltable about said bridge of said base upon depression of said top actuating surface for actuating the aerosol valve to dispense the aerosol product from the aerosol container through said terminal orifice when said actuator button is rotated into said unlocked rotational position;

said entirety of said unitary actuator button being inhibited from tilting about said bridge of said base when said actuator button is rotated into said locked rotational position.

7. An improved actuator for actuating an aerosol valve for dispensing an aerosol product from an aerosol container, comprising:

a base having an axis of symmetry of said base;

said base having an outer ring and an inner ring defined about said axis of symmetry of said base forming an annular void therebetween; and a bridge located in a portion of said void;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with formed from a unitary substantially rigid material for enabling the entirety of said actuator button to move as a unit relative to said base;

a portion of said rigid sidewall of said unitary actuator button extending into said annular void for engaging with said bridge;

said entirety of said unitary actuator button being rotatable relative to said base for movement between a locked rotational position and an unlocked rotational position;

said entirety of said unitary actuator button being tiltable about said bridge of said base upon depression of said top actuating surface for actuating the aerosol valve to dispense the aerosol product from the aerosol container through said terminal orifice when said actuator button is rotated into said unlocked rotational position;

said entirety of said unitary actuator button being inhibited from tilting about said bridge of said base when said actuator button is rotated into said locked rotational position.

* * * * *